US011142395B2

(12) United States Patent
Butler et al.

(10) Patent No.: US 11,142,395 B2
(45) Date of Patent: Oct. 12, 2021

(54) SANITARY CONTAINERS

(71) Applicants: BALDWINS INTELLECTUAL PROPERTY, Auckland (NZ); Butler Concepts Limited, Henderson (NZ)

(72) Inventors: Raymond Thomas Butler, Aukland (NZ); Patricia Margaret Butler, Aukland (NZ); Paul Francis Zwaan, Auckland (NZ); Michael Freeman, Auckland (NZ)

(73) Assignee: Butler Concepts Limited, Henderson (NZ)

( * ) Notice: Subject to any disclaimer, the term of this patent is extended or adjusted under 35 U.S.C. 154(b) by 548 days.

(21) Appl. No.: 14/896,232

(22) PCT Filed: Jun. 4, 2014

(86) PCT No.: PCT/NZ2014/000104
§ 371 (c)(1),
(2) Date: Dec. 4, 2015

(87) PCT Pub. No.: WO2014/196874
PCT Pub. Date: Dec. 11, 2014

(65) Prior Publication Data

US 2016/0114975 A1 Apr. 28, 2016

Related U.S. Application Data

(60) Provisional application No. 61/830,914, filed on Jun. 4, 2013.

(30) Foreign Application Priority Data

May 2, 2014 (NZ) ..... 624472

(51) Int. Cl.
*B65F 1/06* (2006.01)
*B65F 1/14* (2006.01)
(Continued)

(52) U.S. Cl.
CPC ..... *B65F 1/068* (2013.01); *B65B 9/2056* (2013.01); *B65F 1/062* (2013.01); *B65F 1/141* (2013.01);
(Continued)

(58) Field of Classification Search
CPC ..... B65F 1/068; B65F 1/062; B65F 1/141; B65F 1/16; B65F 1/1623; B65F 1/1638;
(Continued)

(56) References Cited

U.S. PATENT DOCUMENTS 1,719,185 A * 7/1929 Lowy ..... B65F 7/00 220/87.1
3,536,192 A 10/1970 Couper
(Continued)

FOREIGN PATENT DOCUMENTS

CN 1668517 A 9/2005
CN 102514862 6/2012
(Continued)

OTHER PUBLICATIONS

International Search Report for PCT/NZ2014/000104 (7pgs).
PCT International Preliminary Report on Patentability for PCT/NZ2014/00104 (70pgs).

*Primary Examiner* — Robert F Long
*Assistant Examiner* — Eduardo R Ferrero
(74) *Attorney, Agent, or Firm* — Fitch, Even, Tabin & Flannery LLP

(57) ABSTRACT

The invention is for a sanitary container to receive and at least temporarily store waste. The container has a hollow housing with an upper aperture, and a portion of the housing can open and reveal the hollow interior. There is an upper part, located substantially above the housing to act as a lid, and this can move to open and close the upper aperture. There is an endless cassette non-rotationally mounted at or
(Continued)

near the upper aperture, which holds a length of shirred plastics tubing which exits the cassette at or near its top and which can flow down through a central aperture of the endless cassette toward a bottom of the housing to form a containment. The containment can then receive waste from the upper aperture when open by the lid. The containment can be accessed by the portion when open, and the containment can be drawn downwardly to form a new containment replenished from the cassette and sealed closed by the sealer unit, and allows removal of the containment.

11 Claims, 27 Drawing Sheets

(51) Int. Cl.
*B65B 9/20* (2012.01)
*B65F 1/16* (2006.01)

(52) U.S. Cl.
CPC ..... *B65F 1/16* (2013.01); *B65F 1/06* (2013.01); *B65F 1/1623* (2013.01); *B65F 1/1638* (2013.01); *B65F 2210/126* (2013.01); *B65F 2210/129* (2013.01); *B65F 2210/167* (2013.01); *B65F 2240/164* (2013.01)

(58) Field of Classification Search
CPC ..... B65F 1/06; B65F 2210/129; B65F 2210/167; B65F 2210/126; B65F 2240/164; B65B 9/2056
USPC ..... 53/459, 567, 576
See application file for complete search history.

(56) References Cited

U.S. PATENT DOCUMENTS 3,754,370 A * 8/1973 Hanson ..... B65B 43/123 53/459
3,763,621 A * 10/1973 Klein ..... B65B 9/15 53/439
3,793,797 A * 2/1974 Roberts ..... B65B 43/36 53/459
3,908,336 A 9/1975 Forslund
3,938,300 A * 2/1976 Lovqvist ..... B65B 9/15 53/576
4,489,538 A * 12/1984 Brak ..... G21F 7/005 452/35
4,790,124 A * 12/1988 Kaji ..... B65B 9/15 53/552
4,869,049 A * 9/1989 Richards ..... B65B 9/15 53/459
5,778,642 A * 7/1998 Fuss ..... B65B 9/15 53/551
5,782,061 A * 7/1998 Clazie ..... B65B 9/15 53/451
5,782,067 A * 7/1998 Fuss ..... B65B 9/15 53/137.2
6,199,714 B1 * 3/2001 Thompson ..... B65F 1/06 220/495.04
6,202,922 B1 * 3/2001 Phillips ..... B65F 1/062 220/908
6,234,339 B1 * 5/2001 Thomas ..... B65F 1/062 220/495.07
6,560,948 B1 * 5/2003 Fuss ..... B65B 9/15 53/459
6,672,472 B1 * 1/2004 Rockwood ..... B65F 1/0026 220/495.08
7,966,792 B1 * 6/2011 Hills ..... F21S 4/10 53/413
8,484,936 B2 7/2013 Tannock
8,910,821 B1 * 12/2014 Stravitz ..... B65F 1/06 220/495.04
2002/0038535 A1 4/2002 Jensen et al.
2002/0162304 A1 * 11/2002 Stravitz ..... B65B 9/15 53/526
2003/0121923 A1 * 7/2003 Morand ..... A47K 11/02 220/495.07
2003/0154696 A1 * 8/2003 Morand ..... B65B 9/15 53/567
2003/0205035 A1 * 11/2003 Bussey, Jr. ..... B65B 9/18 53/576
2005/0028491 A1 * 2/2005 Stravitz ..... B65B 9/15 53/470
2005/0079372 A1 * 4/2005 Schmal ..... B32B 27/08 428/482
2006/0248862 A1 11/2006 Morand
2008/0087668 A1 * 4/2008 Butler ..... B65F 1/10 220/262
2008/0184677 A1 8/2008 Morand
2010/0187235 A1 * 7/2010 Chen ..... B65F 1/10 220/495.06
2011/0000172 A1 1/2011 Morand
2011/0011871 A1 * 1/2011 Licata ..... B65D 83/0805 220/495.07
2011/0056941 A1 3/2011 Ohnishi
2011/0056953 A1 3/2011 Ohnishi et al.
2011/0056967 A1 3/2011 Ohnishi et al.
2011/0232240 A1 * 9/2011 Lacy ..... B65F 1/062 53/576
2012/0211494 A1 8/2012 Morand
2013/0298506 A1 * 11/2013 Lucas ..... B65F 1/062 53/452
2016/0031640 A1 2/2016 Cudworth

FOREIGN PATENT DOCUMENTS

EP 0281355 A2 9/1988
EP 0303517 A1 2/1989
JP 64053903 3/1989
JP H6054604 7/1994
JP H07125802 5/1995
JP H10181801 7/1998
JP 2004528253 A 9/2004
JP 2009520658 A 5/2009
JP 2009143724 A 7/2009
JP 2011079663 4/2011
JP 2011520731 7/2011
WO 9939995 A1 8/1999
WO 0228717 A1 4/2002
WO 02100723 12/2002
WO 2012081985 6/2012
WO 2014196874 A1 12/2014

* cited by examiner

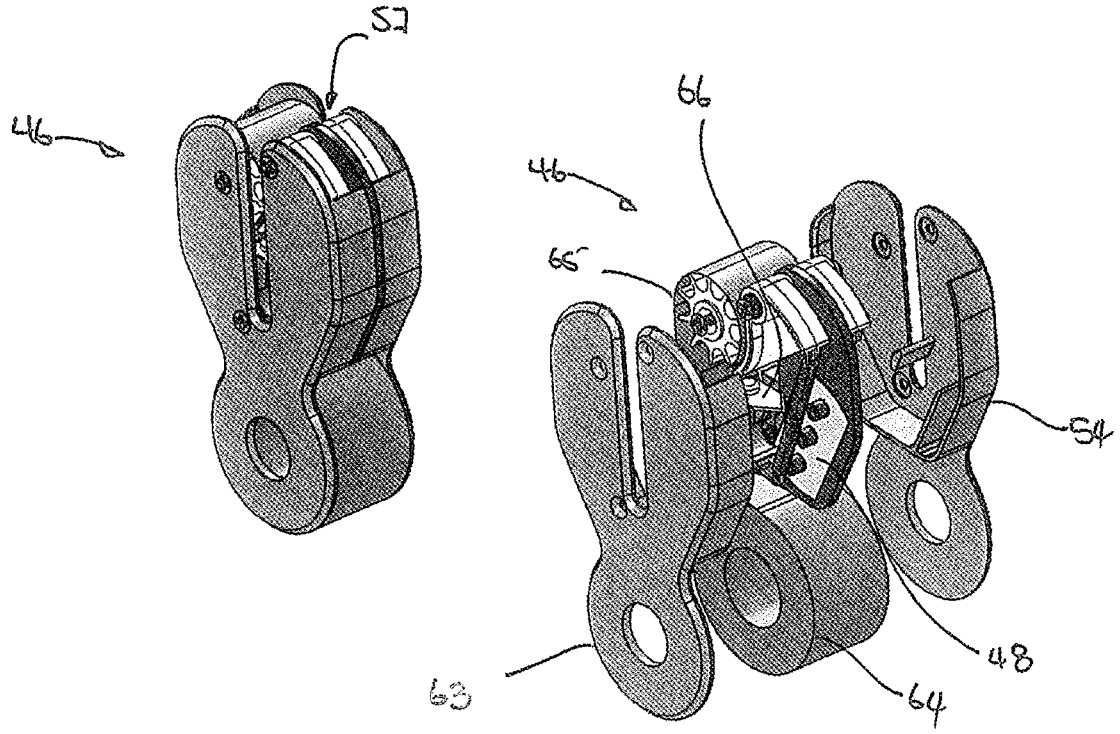
Figure 21 (A) (B)

SANITARY CONTAINERS

CROSS REFERENCE TO RELATED APPLICATIONS

This is a U.S. national phase application of International Application No. PCT/NZ2014/000104, filed Apr. 6, 2014, designating the United States and claiming, which claims the benefit of U.S. Provisional Application No. 61/830,914 and New Zealand Patent Application Number 624472, all of which are hereby fully incorporated by reference as if fully set forth herein.

TECHNICAL FIELD

The present invention relates to sanitary containers. In particular, though not solely, the present invention is directed to sanitary disposal containers, and components therefor, for example for location in a washroom cubicle or similar for disposal of waste.

BACKGROUND

There is a need for containers to retain, at least temporarily, waste in a sanitary fashion, particularly containers that are designed for the disposal of women's sanitary products. Such containers are usually floor or wall mounted in a washroom cubicle.

Such containers are necessary as flushing of such products down the toilet can cause blockage and the local waste water system may not be, or is not desired to be, able to handle such bulky items.

Sanitary containers are usually accessed by opening a flap or similar which allows waste material to be placed into the container. This usually requires the user handles the container around the area of access to its interior, for example the lid, to allow placement of the waste material therein. This can be a problem as handling the container can contaminate it and accumulate waste material in an area around the access to the container interior, which can be unsightly, and potentially a health hazard. It is also preferably from a user's perspective that there is no, or little need, to handle the container to open the lid, or similar, to place the waste therein with little or no soiled surfaces showing. It is also preferable that when the lid is open the sizing of the aperture, and relative dimensions of the storage area are such that sight into the unit, and therefore its waste content is minimised.

The containers are not generally emptied on site, but are taken away and replaced with a fresh bin, due to the hazardous nature of the waste. In the past this has required the person servicing the container have a second container for each container they are replacing. This means normally either many trips to and from the washroom facility, or some form of trolley to carry new containers in and carry used containers out. If the containers are wall mounted, an advantage for cleaning the cubicle, then unless the mounting is well designed it will wear and possibly break over multiple removal and replacement cycles. It is therefore desirable if the container can stay in the washroom and only the waste content therein is removed.

An example of such a sanitary container where the entire unit is taken away and replaced is that shown in our international application WO 2005/115882. This can be wall mounted or floor standing.

It is also desirable that servicing of the unit is straight forward and simple and can proceed as easily and intuitively as possible.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved sanitary container, or to overcome the above shortcomings or address the above desiderata, or to at least provide the public with a useful choice.

BRIEF DESCRIPTION

In a first aspect the present invention may be said to broadly consist in a sanitary container adapted to receive and at least temporarily store waste, comprising or including,

- A housing having a hollow interior and an upper aperture, with a portion of said housing able to open and reveal at least in part, said hollow interior,
- An upper part, located substantially above said housing to act as a lid, movable to open and close at least in part said upper aperture,
- An endless cassette non-rotationally mounted at or near said upper aperture, to hold a length of shirred plastics tubing which exits said cassette at or near its top and which can flow down through a central aperture of said endless cassette toward a bottom of said housing to form a containment,
- Such that said containment can receive said waste via said upper aperture when open by said lid,
- And wherein said containment can be accessed by said portion when open, and said containment can be drawn downwardly to form a new containment replenished from said cassette and sealed closed by said sealer unit, and allowing removal of said containment.

Preferably said endless cassette is located within said housing and locates substantially outside a periphery of said upper aperture.

Preferably said housing at least in part contains a sealer unit located at or near said bottom to place at least one seal on said plastics tubing to close off said containment and or close a lower part of said new containment.

Preferably said sealer unit also has a cutter to sever said plastics tubing, said cutter to cut downstream of said seal, thus allowing removal of said containment from said new containment.

Preferably said sealer unit can place a second said seal, downstream of said cutter, such that said cutter seals said new containment and also cuts and seals said containment for removal.

Preferably said portion hinges outwardly from a pivot point toward said bottom.

Preferably said sealer unit moves outwardly also from inside said housing when said portion is open.

Preferably said cassette has an upper surface which slopes upwardly and inwardly to said central aperture.

Preferably said exit for said shirred plastics tubing is immediately proximal said central aperture.

Preferably said endless cassette is formed from an internal mandrel about which said plastics tubing is located and over and about which is located an outer cover, that between said internal mandrel and said outer cover define said exit for said plastics tubing at or near its said top.

Preferably said endless cassette is substantially complimentary to an interior surface of said housing.

Preferably said lid is slidingly engaged with an outer rear surface of said housing.

Preferably said portion is retained in a closed position by at least one releasable engagement with said housing.

Preferably said at least one releasable engagement is at a side of said portion towards a top thereof.

Preferably said lid has a handle to raise and lower said lid to open and close said upper aperture.

Alternatively said upper aperture is opened and closed by said lid automatically.

Preferably said automatic open and closing is via a proximity sensing.

Preferably said lid has a visual indication, for example a target thereon to indicate to a user the location of said proximity sensing.

Preferably said sanitary container is substantially rectilinear in front and side views, save for curved sides, top and bottom thus providing substantially smooth continuous surfaces to aid in hygiene and cleaning.

Preferably a lowermost portion of said housing is substantially concave when viewed from an interior thereof, said concavity to catch any leakage or spill from said waste.

Preferably said lid includes a retention mechanism which readily prevents complete removal from the housing.

Preferably said container can be removably wall mounted or floor standing.

Preferably said endless cassette has a releasable engagement with said housing.

Preferably said releasable engagement is a resilient one.

Preferably said resiliently releasable engagement is at least one first protruding portion on a forward facing surface of said cassette to engage in a complimentary portion on an interior surface of said housing, and at least one second protruding portion to engage on another interior surface of said housing.

Preferably said at least one first protruding portion is at a different height to said at least one second protruding portion such that said endless cassette is located into place by engaging first either of said at least one first protruding portion or said at least one second protruding portion and then said at least one second protruding portion or said at least one first protruding portion respectively.

Alternatively said cassette is held in place by at least an upper portion thereof being complimentary to an interior of said sanitary container such that said cassette is retrained from moving upwardly or outwardly, and a press bar releasably supports said cassette from below.

Preferably said upper aperture which said lid closes has a frustoconical mating surface that is inwardly sloped, and said lid has a complimentary mating surface to substantially seal said upper aperture.

Preferably said container can be mounted via a rearward surface to a wall, or be free standing on a floor.

Preferably an automatic opener can mount to a rearward surface of said container to open and close said lid automatically.

In yet another aspect the present invention may be said to broadly consist in a cassette for a sanitary container, comprising or including, A central mandrel, about which a length of plastics tubing can be located in a shirred state, said central mandrel having a central aperture running therethrough, An outer cover to locate about said central mandrel and said shirred plastics tubing, Said central mandrel and said outer cover to thereby enclose said shirred plastics tubing save for an endless exit aperture at an uppermost periphery of and immediately adjacent to said central aperture, whereby said shirred plastics tubing can leave said cassette via said endless exit aperture and which then can flow in an un-shirred state down through said central aperture of said cassette.

In another aspect the present invention may be said to broadly consist in a cutter sealer unit to seal a plastics tubing, from a supply or plastics tubing, for a sanitary container, comprising or including, a first sealing mechanism to place a first seal on said plastics tubing, and a severing mechanism adapted to sever any said plastics tubing extending after said first seal wherein when said first seal is located on said plastics tubing a new containment is formed for said sanitary container.

Preferably there is a second sealing mechanism adapted to place a second seal downstream of said first seal and said severing mechanism, such that when said new containment needs replacing (for example it contains waste), a further length of plastics tubing is obtained from said supply, and said full containment and any said waste therein is sealed off by said second sealing mechanism, and severed from said further length, and said further length is sealed by said first sealing mechanism to form a new containment.

In another aspect the present invention may be said to broadly consist in a method of use of a sanitary container, comprising or including the steps of, Accessing an internally non-rotationally mounted endless cassette of said container, Drawing downward from a central aperture of said endless cassette a plastics tubing to form a containment, Sealing said containment at a lower end thereof to close a said lower end, To thereby provide a removable containment for waste within said container, and thereafter closing said container.

Preferably said method includes sealing an upper most end of said existing containment to fully seal said existing containment and any waste therein.

Preferably the steps of sealing said new containment, severing said existing containment and sealing said existing containment are achieved by a combined sealer and cutter unit which applies a seal either side of said sever.

In another aspect the present invention may be said to broadly consist in a method of use of a sanitary container, comprising or including the steps of, Accessing an internally mounted endless cassette of said container, Drawing downward an existing containment within said container to form a new containment replenished from a central aperture of said endless cassette Sealing said new containment at a lower end thereof to close a said lower end, and Severing said existing containment from said new containment, To thereby allow removable of said existing containment and any waste therein from said container and thereafter closing said container.

Preferably said method includes sealing an upper most end of said existing containment to fully seal said existing containment and any waste therein.

Preferably the steps of sealing said new containment, severing said existing containment and sealing said existing containment are achieved by a combined sealer and cutter unit which applies a seal either side of said sever.

In another aspect the present invention may be said to broadly consist in a sanitary container adapted to receive and at least temporarily store waste, comprising or including, A housing having a hollow interior and an upper aperture, and lower aperture communicating to said interior, An upper part, located substantially above said housing to act as a lid, movable to open and close at least in part said upper aperture, A lower part, located substantially below said upper part, to further define said hollow interior, said lower part to move relative said housing from, a lowered position, where access to said hollow interior is available at least through a first aperture in a side wall of said lower part, or a second aperture in an upper region thereof, a raised position where said first aperture and second aperture are covered by said housing, A supporting frame substantially located within said lower part and adapted to removably receive and retain a liner such that it is open to said hollow interior from above, whereby at least said liner, can be removed and replaced from and to said lower part when in said lowered position, and at least when in said raised position, waste can be placed into said liner in said interior volume when said upper aperture is open.

Preferably said upper aperture has a sealing member to seal against said upper part to substantially retain odours within said hollow interior.

Preferably said upper part can move to completely close said upper aperture.

Preferably said liner is a plastics material bag.

Preferably said liner can be removed and replaced from either or both said first aperture or second aperture when in said lowered position.

Preferably said upper perimeter of said lower portion defines a hoop portion.

Preferably said hoop portion is integral with said lower part.

Preferably said hoop portion is integral with said lower part.

Preferably an upper perimeter of an opening of said liner is folded over said supporting frame from an interior to an exterior thereof.

Preferably said folded over upper perimeter of said liner is captured and retained between said supporting frame and said hoop portion.

Preferably said support frame is a continuous ring.

Preferably said support frame can engage and be selectively retained to said lower part.

Preferably said upper part as a lid is mounted to said housing in a sliding, hinging or telescoping way to open and close said upper aperture.

Preferably said upper part has a handle to raise and lower said upper part to open and close said upper aperture.

Alternatively said upper aperture is opened and closed by said upper part automatically.

Preferably said automatic open and closing is via a proximity sensing.

Preferably said lower part is in sliding engagement to said housing to move from said lower position to said lower position.

Preferably said sliding engagement allows retention in use of said lower part in said raised position, and removal of said lower part in said lowered position.

Preferably said retention and removal is achieved by overcoming a repeatable resilience of said lower part relative to said housing.

Preferably said upper part has a target thereon to indicate to a user the location of said proximity sensing.

Preferably said sanitary container is substantially rectilinear in front, side and plan views.

Preferably said upper part includes a retention mechanism which readily prevents removal from the housing.

Preferably the upper part and said housing co-operate to prevent the upper part from moving downward past the upper aperture when in said closed position.

Preferably the housing further includes an external support flange as part of said co-operation.

Preferably the upper part further includes a lip as part of said co-operation.

Preferably said container can be wall mounted or floor standing.

Preferably said hollow interior has provision for location of at least one freshness product.

Preferably said upper part includes a lower skirt is located inside said housing even when in said open position.

Preferably said lower skirt has a waste aperture therethrough to allow insertion of waste into said interior, when in said open position.

Preferably said lower skirt locates inward of said housing, but outward of said supporting frame.

Preferably said lower part includes an upper skirt that is located inside said housing at least when in said raised position.

In another aspect the present invention may be said to broadly consist in a method of providing a sanitary container adapted to receive and at least temporarily store waste, comprising or including the steps of, Providing a housing having a hollow interior and an upper aperture, and lower aperture communicating to said interior, Providing an upper part, located substantially above said housing to act as a lid, movable to open and close at least in part said upper aperture, Providing a lower part, located substantially below said upper part, to further define said hollow interior, said lower part to move relative said housing from, a lowered position, where access to said hollow interior is available at least through a first aperture in a side wall of said lower part, or a second aperture in an upper region thereof, a raised position where said first aperture and second aperture are covered by said housing, providing a supporting frame substantially located within said lower part and adapted to removably receive and retain a liner such that it is open to said hollow interior from above, whereby at least said liner, can be removed and replaced from and to said lower part when in said lowered position, and at least when in said raised position, waste can be placed into said liner in said interior volume when said upper aperture is open.

In yet another aspect the present invention may be said to broadly consist in a method of servicing of a sanitary container, adapted to receive waste, comprising or including the steps of Lowering a lower part of said sanitary container from a housing to expose at least a first aperture, otherwise not exposed when said lower part is in a raised position to said housing, Removing a liner, containing any waste received by said container, at least through said first aperture, whereby said liner is retained to an interior of said lower part via at least an internal perimeter of a support frame engaged therewith, Replacing said liner, Raising said lower part up into said housing, Such that new waste material can then be located into said container and said liner via an upper aperture thereof which can be selectively closed and opened via an upper part, at least when said upper part is in said open position.

In still yet another aspect the present invention may be said to broadly consist in a kit of parts for a sanitary container, comprising or including, A housing having a hollow interior and an upper aperture, and lower aperture communicating to said interior, An upper part, for assembly with and location above said housing able to act as a lid, movable to open and close at least in part said upper aperture, A lower part, for assembly with and location substantially below said upper part, to further define said hollow interior, said lower part, when assembled to move relative said housing from, a lowered position, where access to said hollow interior is available at least through a first aperture in a side wall of said lower part, or a second aperture in an upper region thereof, a raised position where said first aperture and second aperture are covered by said housing, A supporting frame for assembly with and location substantially within said lower part and adapted to removably receive and retain said liner such that it is open to said hollow interior from above, whereby at least said liner, when said sanitary container is assembled, can be removed and replaced from and to said lower part when in said lowered position, and at least when in said raised position, waste can be placed into said liner in said interior volume when said upper aperture is open.

In another aspect the present invention may be said to broadly consist in a sanitary container as herein described with reference to any one or more of the accompanying drawings.

In another aspect the present invention may be said to broadly consist in the use of a sanitary container as herein described when serviced as herein described.

In another aspect the present invention may be said to broadly consist in a method of providing a sanitary container as herein described when serviced as herein described.

In another aspect the present invention may be said to broadly consist in consist in a method of servicing of a sanitary container as herein described when serviced as herein described.

In another aspect the present invention may be said to broadly consist in consist a kit of parts for a sanitary container, as herein described when serviced as herein described.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present, but other features can also be present. Related terms such as "comprise" and "comprised" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

The entire disclosures of all applications, patents and publications, cited above and below, if any, are hereby incorporated by reference.

To those skilled in the art to which the invention relates, many changes in construction and widely differing embodiments and application of the invention will suggest themselves without departing from the scope of the invention as defined in the appended claims. The disclosures and the descriptions herein are purely illustrative and are not intended to be in any sense limiting.

Other aspects of the invention may become apparent from the following description which is given by way of example only and with reference to the accompanying drawings.

BRIEF DESCRIPTION OF THE DRAWINGS

Preferred forms of the present invention will now be described with reference to the accompanying drawings in which.

DETAILED DESCRIPTION

Figure 2:
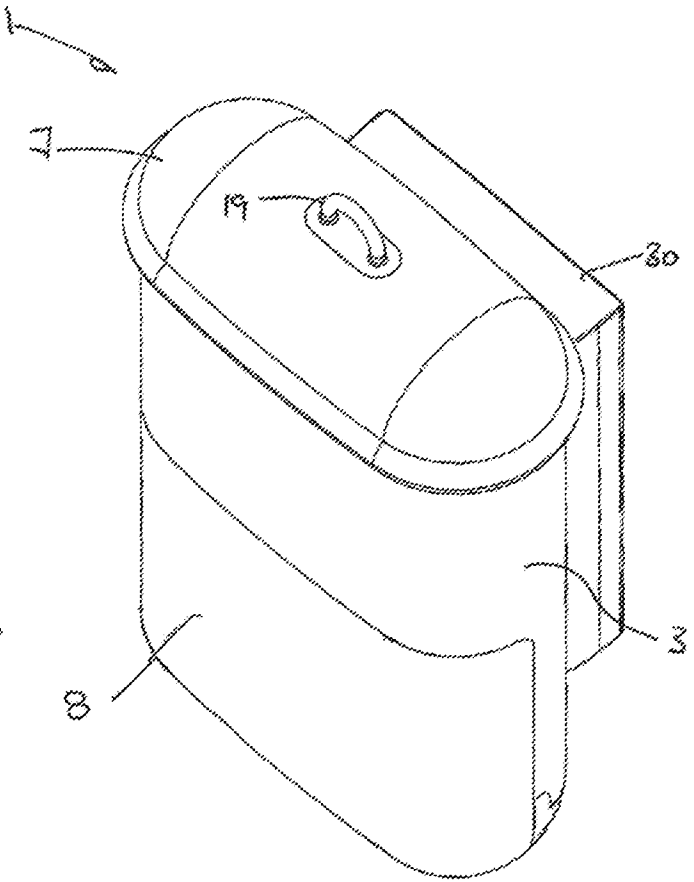
Figure 1:
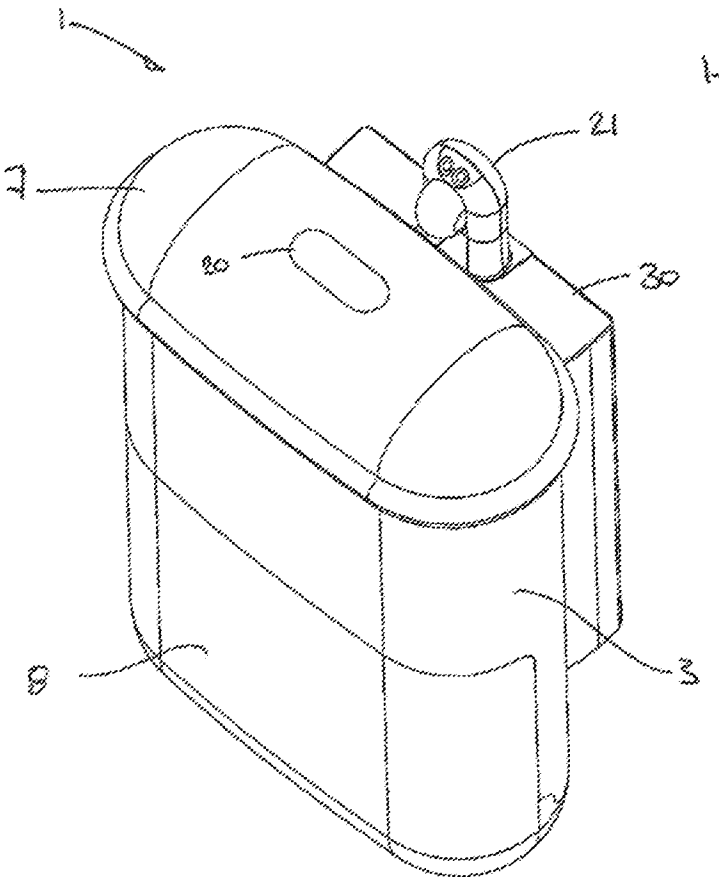
FIG. 1 Shows in right hand top isometric view a first embodiment of the present invention, where the lid is actuated by a sensor and the lid is down, FIG. 2 Shows a similar view to that of FIG. 1 of a second embodiment, where the lid is hand actuated and the lid is again down, FIG. 3 Shows a rear perspective view of the present invention with no rear mount in place, FIG. 4 Shows a similar view to that of FIG. 3 with the rear mount in place, FIG. 5 Shows a side view of the present invention with the rear mount in place, FIG. 6 Shows a side vertical cross section along a mid plane, showing the interior of the present invention without the bag in place, FIG. 7 Shows the rear perspective view of the housing and upper part, with the lower part removed, FIG. 8 Shows a front view of the upper part and housing, again with lower part removed, FIG. 9 Shows a similar cross section to that of FIG. 6 with the addition of the bag, FIG. 10 Shows a similar view to that of FIG. 9 with the lower part removed, FIG. 11 Shows a front perspective view of the lower part, supporting frame and bag, FIG. 12 Shows an exploded view of FIG. 12, FIG. 13 Shows a front perspective view of the present invention with upper part (lid) removed, and lower part lowered for access into the internal volume for removal and replacement of the bag, FIG. 14 Shows a further view of that of FIG. 13 showing the sliding and engagement/disengagement mechanism of the lower part to the housing FIG. 15 Shows at (A) detail A from FIG. 13 of the lower part and support frame, (B) a side cross section along a mid-plane of (A), and (C) the same view as (B) but with the slower part removed, FIG. 16 Shows a close up of the upper part (lid) in the (A) lowered condition, (B) cross section of the lowered position, and (C) cross section of the raised position, FIG. 17 Shows a further embodiment of the present invention in perspective view with a portion of the housing open to reveal its interior, with (A) being the containment formed from a plastics tube, (B) being the containment formed from a more rigid material as a reusable container, (C) being a free standing floor version with the portion closed, (D) showing the rear of the container and the sliding track for the lid, FIG. 18 Shows the endless cassette in isometric view, FIG. 19 Shows the endless cassette in isometric view with a length of plastics tubing pulled from it, FIG. 20 Shows an upper cross section of the container and endless cassette in cross section along line AA of FIG. 17A, and the sequence of installation of the endless cassette, FIG. 21 Shows Cutter sealer unit at (A) in isometric and at (B) in exploded isometric, the unit has a seal placing apparatus either side of a cutter, (C) shows a left hand side view of the most preferred form of the cutter sealer unit with cover removed to show the interior prior to actuation, (D) shows the cutter sealer unit having received the gathered plastics tubing and applying a first and also a second seal, (E) shows the seal being cut by the tape cutter, and (F) shows the sealed plastics tube being cut away by the bag-cutter, FIG. 22 Shows at (A) in isometric cross section along line BB of FIG. 19 the result of drawing down the existing containment and sealing and severing this from a new containment, drawn down from the cassette which is also sealed at the time of cutting and sealing off the existing containment, also showing the cassette in cross-section, (B) showing a full containment sealed with the second seal and severed from a new containment which is sealed with a first seal, and (C) an alternative containment as a more rigid container which may be reusable, FIG. 23 Shows an isometric front right hand view of a further embodiment of the present invention having a press bar, FIG. 24 Shows a similar view to that of FIG. 23 with the front cover removed to reveal the interior of the sanitary container and press bar, FIG. 25 Shows a close up view of the interior of the sanitary container, and the engagement of the press bar to hold the cassette in place, and also the clip portions of the press bar, FIG. 26 Shows a close up vertical cross section on a plane running from front to back of the sanitary container and the engagement of the cassette into the upper region of the container top, and its support by the press bar, FIG. 27 Shows a vertical cross section of the container on a plane funning from front to rear with the lid partly raised, showing the sliding support for the lid, FIG. 28 Shows a further cross sections, similar to FIG. 27, showing the interface of the wall bracket and its supporting the container, and FIG. 29 Shows a close up top isometric view of the upper region of the container with the lid partly open, showing in close up the mating of the lid and the upper portion to seal the hollow interior.
Figure 4:
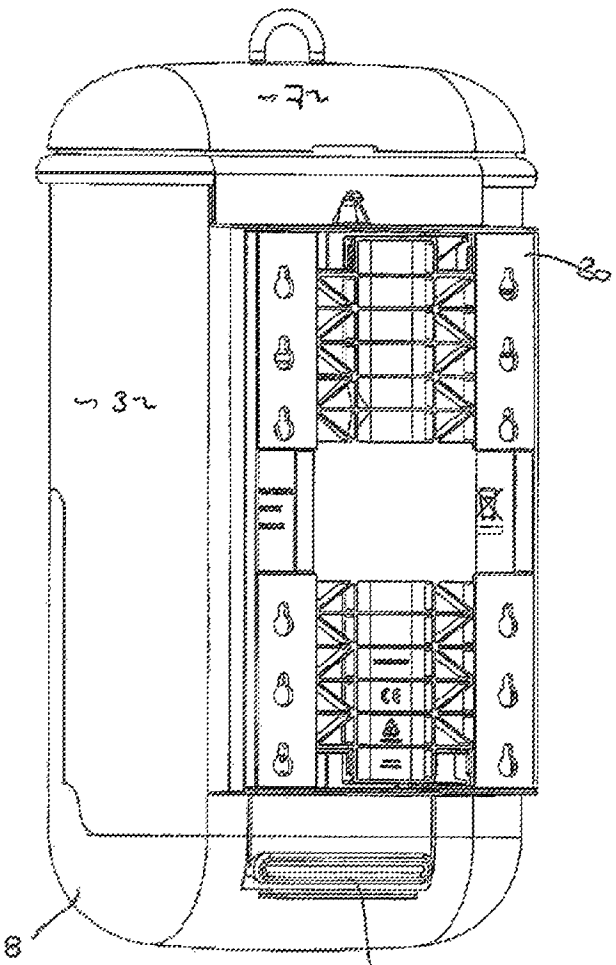

Preferred embodiments will now be described with reference to FIGS. 1 through 21. FIG. 1 shows the sanitary container 1 of the present invention in a first embodiment where a auto opener 21 is used to open and close the sanitary container 1. The auto opener 21 has a proximity sensor 20. A target 25 may also be on the top or other wise of the upper part 7, to show a user where to place their hand in proximity to, to open the upper part. In FIG. 2 is the same sanitary container 1 with the exception the container is open and closed manually by a handle 19. The sanitary container can be freestanding, for example on the floor of a wash room cubicle or similar, using a stand of some description, or alternatively, maybe wall mounted via wall mount 30 that locates in the preferred embodiment to a rear surface of the sanitary container 1 for example as shown in FIG. 4.

Figure 13:
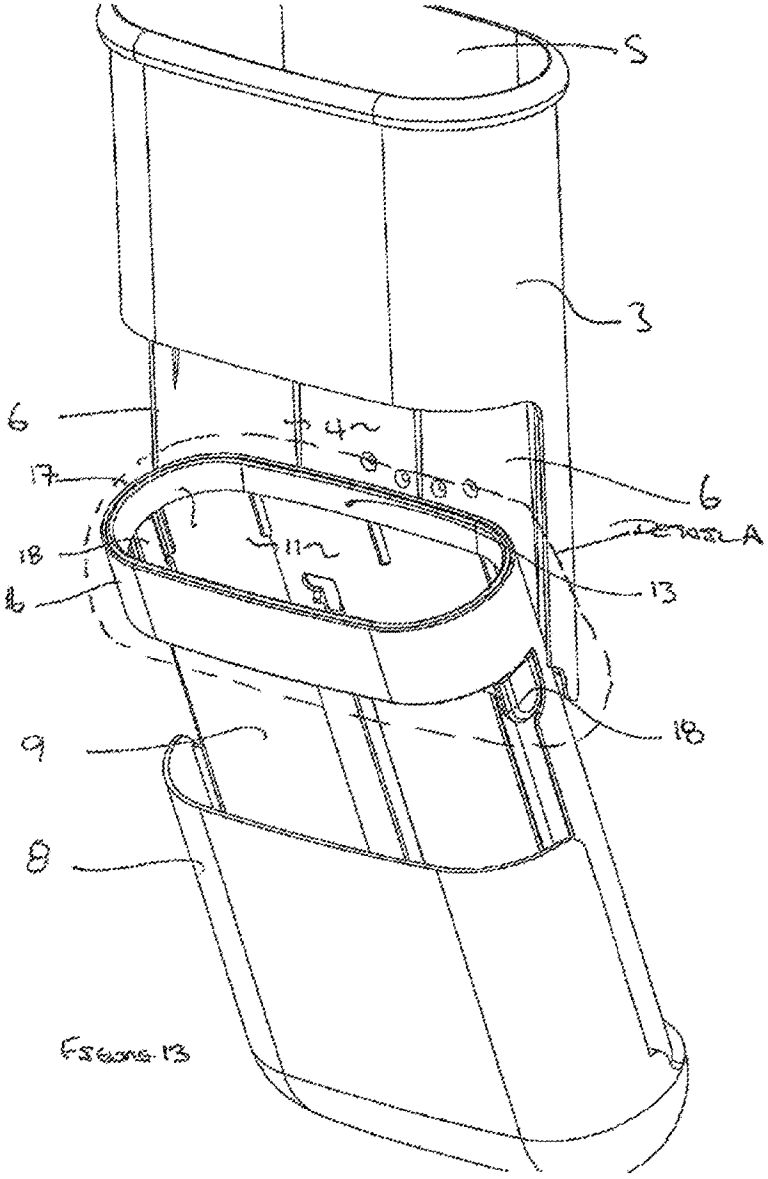
Figure 5:
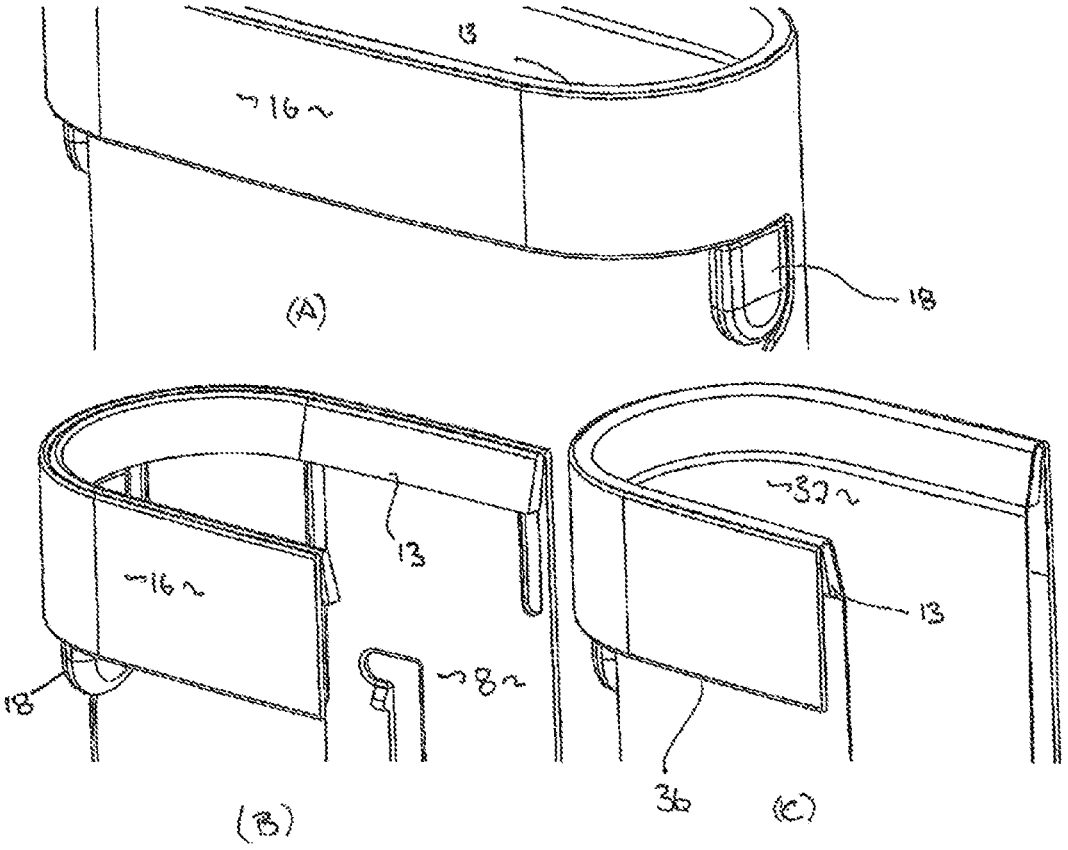
Figure 16:
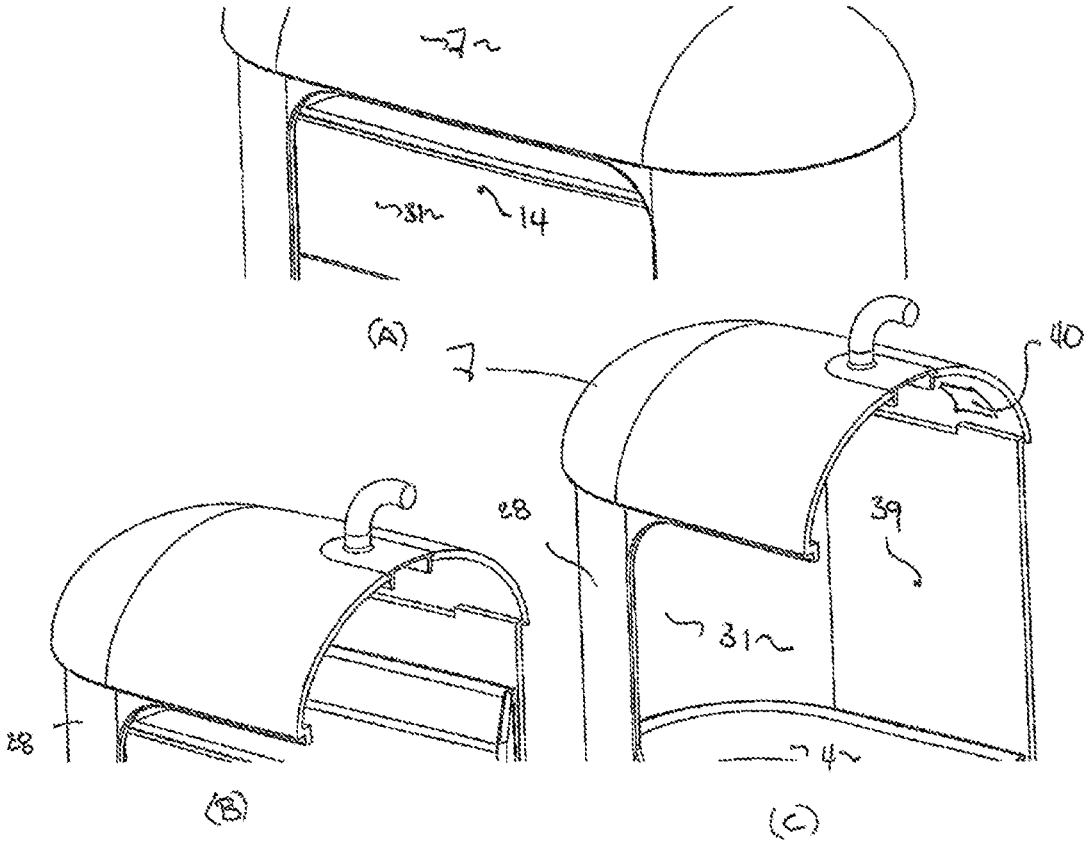

The sanitary container 1 consists of a housing 3. The housing 3 has an upper aperture 5, as shown in FIG. 13, and a lower aperture 6 also as shown in FIG. 13. The upper aperture 5 is selectively closeable and openable via an upper part 7 which acts as a lid. The upper part 7 is shown in FIGS. 1 through 10 in the closed position and in FIG. 16*c* in the raised position. The upper part 7 as show in FIG. 16*c* has a waste aperture 31 which when the upper part 7 is in the open position waste material can be located into the interior 4 of the container.

As earlier mentioned the raising and lowering of the upper part 7 to close and open the upper aperture 5 can occur automatically via an automatic opener, for example 21, or manually via a user raising the upper part 7, for example via a handle 19. In preferred forms of the invention, the sanitary container 1 can be converted from an auto opening system to a manual system simply by removal of the handle 19 and addition of an auto opener 21 to actuate the upper part 7, and vice versa.

Figure 8:
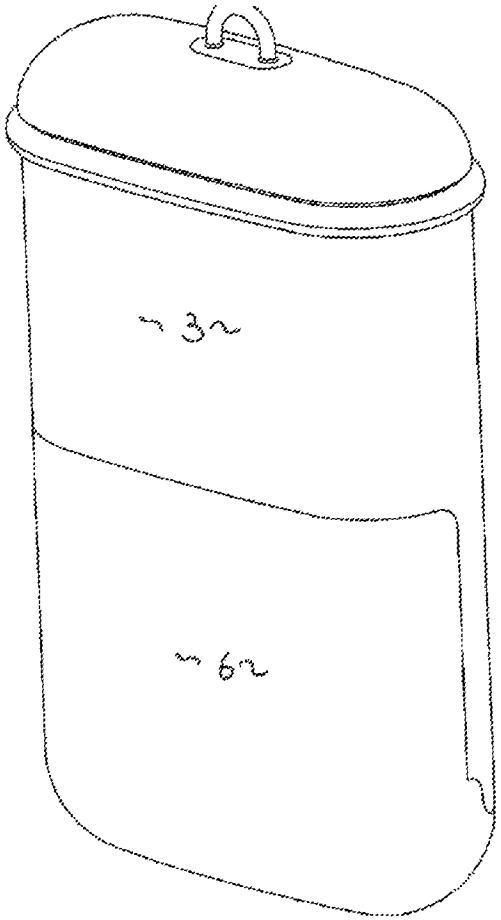
Figure 14:
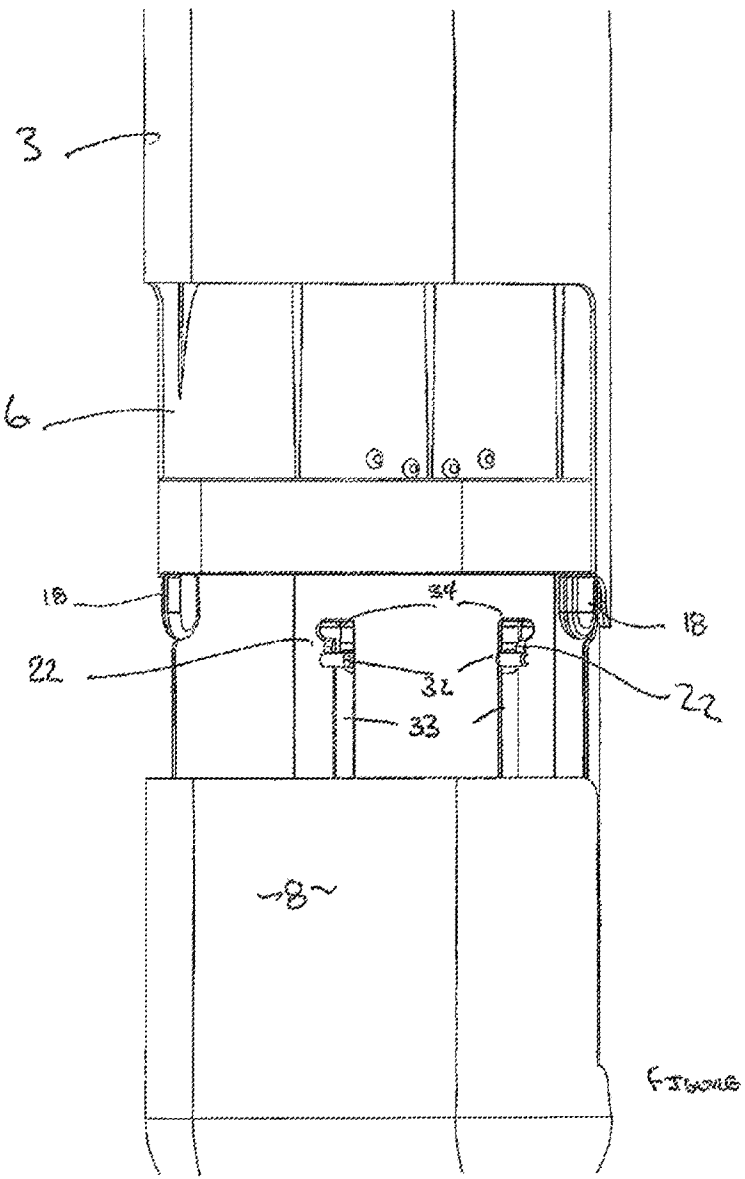

The housing 3 has a lower aperture 6 as shown in FIG. 8 which a lower part 8 can when in a raised position as shown in FIG. 1 closes off the lower aperture 6. The lower part 8 has an upper skirt 29 which resides inside the housing 3, at least when in the raised position, and defines a hoop portion 16. When the lower part 8 is in a lowered condition as shown for example in FIG. 13 the lower aperture 6 is opened. In the preferred embodiment the lower part 8 is in sliding engagement with the housing 3 via sliding engagement means 22 as shown in FIG. 14. In the preferred embodiment this consists of lugs 32 located on an interior surface of the housing 3 which engage in tracks 33 in the lower part 8. In the track 33 allows for passing through of the lugs 32 in an extreme lowered position for subsequent removal and attachment of the lower part 8 to the housing 3. In reverse this is also how the lower part 8 can be assembled to the housing 6.

Figure 9:
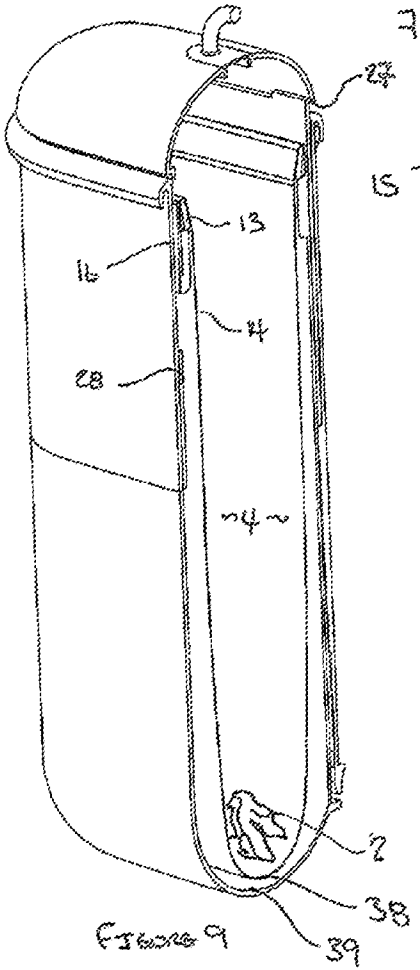

The upper part 7, housing 3 and lower part 8 (when in the raised position) form a hollow interior 4 as shown in FIG. 9. A sealing member 15, seen in FIG. 10, may be present between the upper part and the housing to keep odours in and cushion the closing of the upper part 7. A lip 27 exists between the upper part 7 and the housing 3 to stop the upper part from moving further down into the housing 3 as shown in FIG. 9. The lower skirt 28 of the upper part 7 locates between the inward facing surfaces of the housing 3 and the outward surfaces of the receptacle 14 in a sleeved arrangement as shown in FIG. 9.

Figure 5:
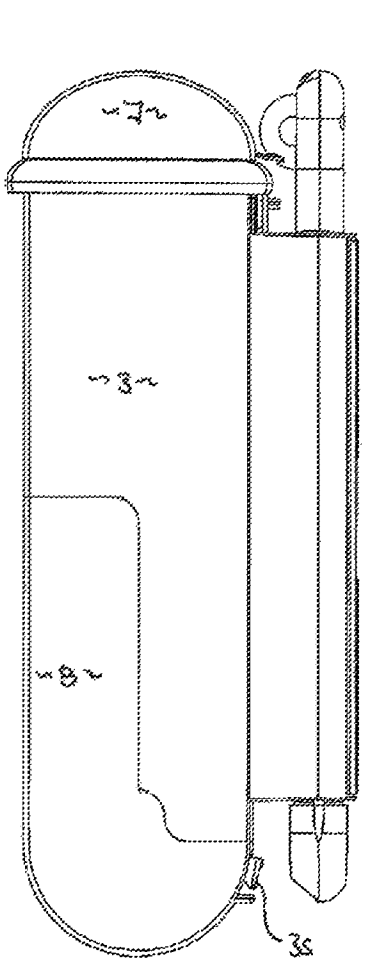
Figure 3:
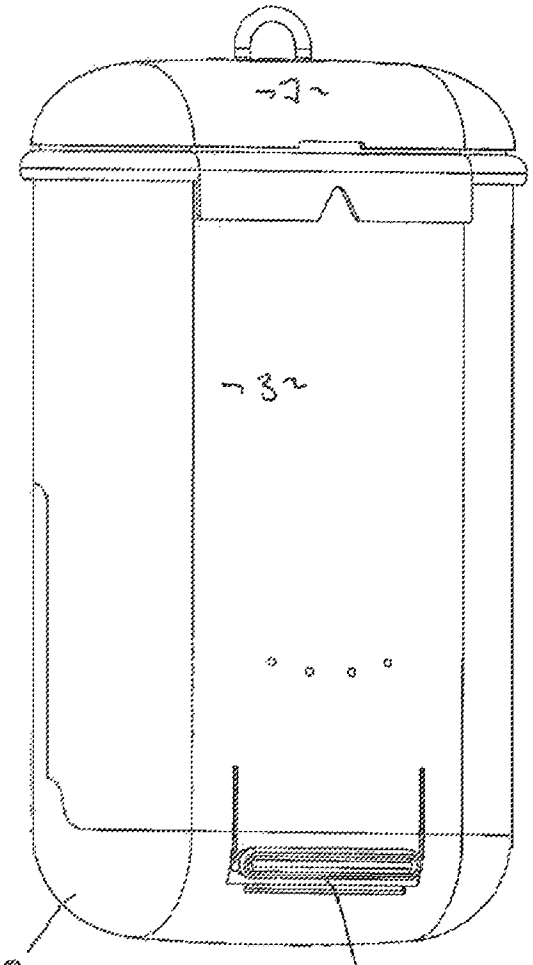
Figure 7:
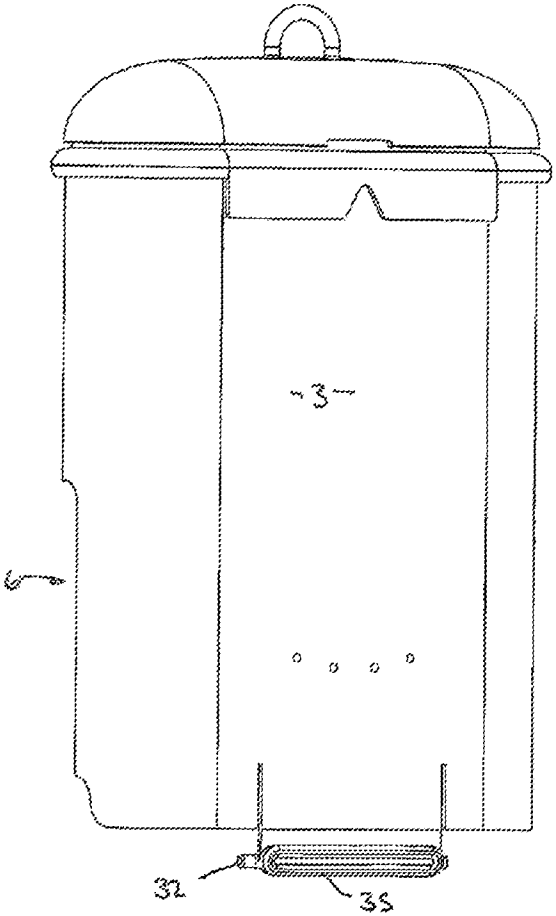
Figure 6:
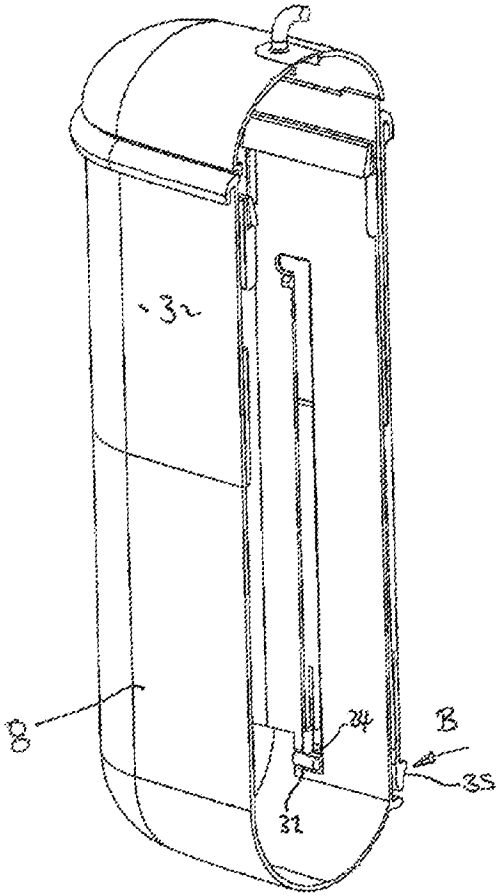
Figure 10:
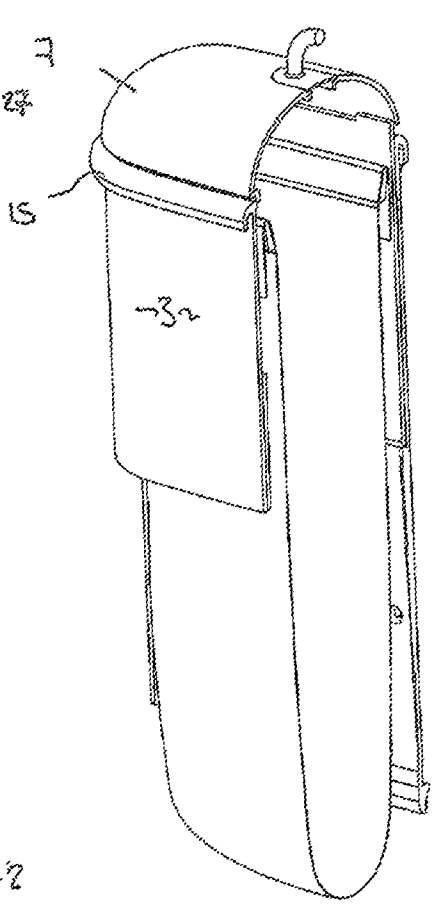

When the lower part 8 is in the raised position as shown in FIGS. 3, 4 and 5, a latch 35 is used to retain it in the raised position. Release of the latch, for example by a maintenance person will allow lowering of the lower part 8 to a position, for example as shown in FIG. 13 or intermediate of FIG. 13 and FIG. 3 for example. The latch 35 for example may be a resilient mount for the lugs 32 and as shown in FIG. 6, the lugs 32 may rest on a detent 24 that normally would prevent lowering of the lower part 8 relative the housing 3 yet when the latch 35 and thus the lugs 32 are bent in the direction B, against an innate bias (for example elastic deformation, or a spring bias) as shown in FIG. 6 the lugs 32 clear the detent 24 and allow lowering of the lower part 8. Catches and other means will be known in the art as alternatives.

Figure 11:
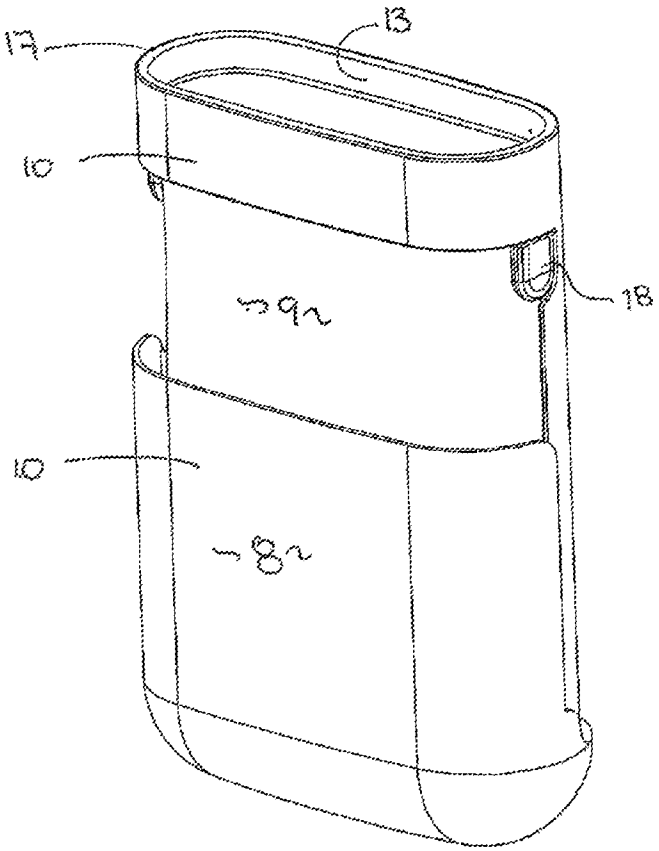

The housing 3 upper part 7 and lower part 8 together define a hollow interior 4 within the sanitary container. The lower part 8 has an upper perimeter 17 which in the preferred embodiment forms a hoop portion 16. The hoop portion or part thereof also forms a first aperture 9 in a side wall 10 of the lower part 8, as shown in FIG. 11. The hoop portion, or part thereof also forms a second aperture 11 towards the top of the lower portion 8.

Figure 12:
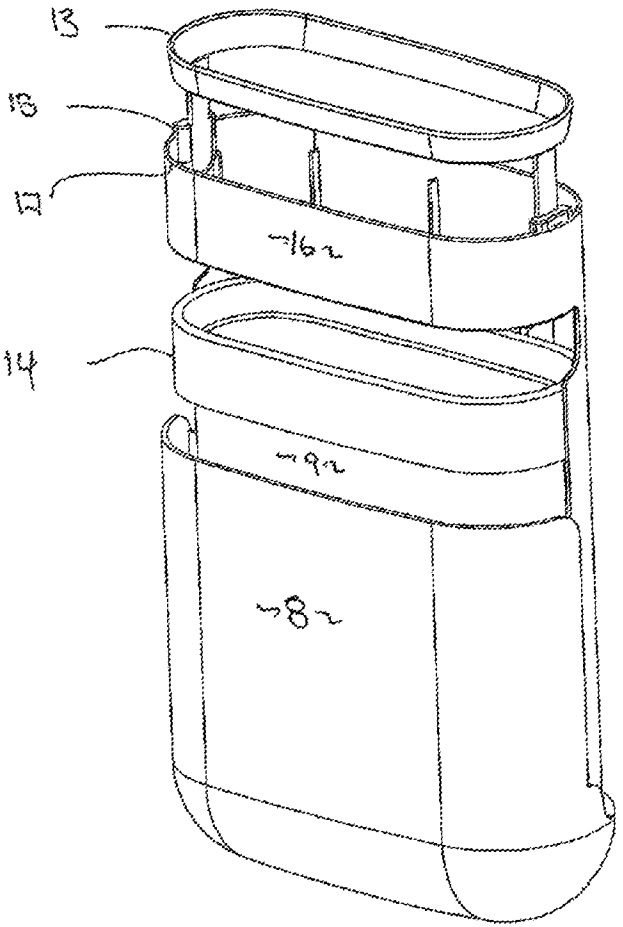

Residing within and preferably congruent to the upper perimeter 17 is a supporting frame 13 as shown in FIGS. 11 through 15. Engaging means 18 allow this to be selectively engaged and disengaged from the lower portion 8 as shown in FIG. 12.

A thin walled liner 14 is located in the interior volume of the lower part 8. In the preferred embodiment the receptacle 14 is a plastics bag or similar. The perimeter 36 of the opening 37 of the receptacle 14 is folded over the upper region from the interior of the support frame 13 to lie over the exterior as shown in FIG. 13(C). The support frame 13 with the receptacle 14 in this arrangement can then be located into place within the hoop portion 16, such that the folded over part of the perimeter is effectively sandwiched between the hoop portion 16 and the support frame 13 as shown in FIG. 9. Such a sandwiching, preferably a tight one, retains the receptacle 14 in place.

The support frame 13 can be located into place (or removed) either from above the hoop portion 16, or upwardly from below via the first aperture 9. Thus with the lower part 8 in the lowered position the receptacle 14 can easily and sanitarily be removed from the container 1. A new or cleaned receptacle can then be replaced into portion and retained by the support frame 13 as described above. The lower part 8 can then be raised and located with the housing.

The receptacle preferably is so proportioned than when located in place by the support frame 13, the bottom 38 of the receptacle 14, rests in the lower inner surface 39 of the lower part 8. Thus the retention of the receptacle by the support frame 13 and hoop portion 16 is relatively unstressed.

When the upper part 7 is raised for insertion of waste into the container, the lower skirt 28 slides up and presents the waste aperture 31 as shown in FIG. 16(C). The user can then deposit waste 2 into the container, which will then rest in the interior of the receptacle 14 or liner. When the liner is full this can be removed, cleaned or replaced as above. Because the lower skirt 28 moves up with the upper part (it is preferably unitary therewith) the only surfaces substantially presented to the user in the interior of the container 1 are the inner surfaces 39 of the lower skirt 28 and the liner 14 itself. Thus the majority in the interior of the container 1 is kept clean. The waste aperture 31 is proportioned such that waste material inside the container cannot be seen by the user as the container is sufficiently deep, and the waster aperture is of sufficiently low height that a user cannot "see down" into the container. Regular servicing and removal of waste will aid this and prevent overfill. When the upper part 7 is lowered the waste aperture 31 is closed off by the housing and also seals the interior volume to keep any odours inside.

A freshness product 40 may also be contained within the container 1, such as for example in the underside of the upper part 7 to help control any odour.

The container 1 may be sold as an individual assembled item, or as a kit for assembly into a container 1.

A further embodiment of the present invention is shown in FIGS. 17 through 26. In this embodiment the same numerals refer to the same features as in the previous embodiment.

Figure 26:
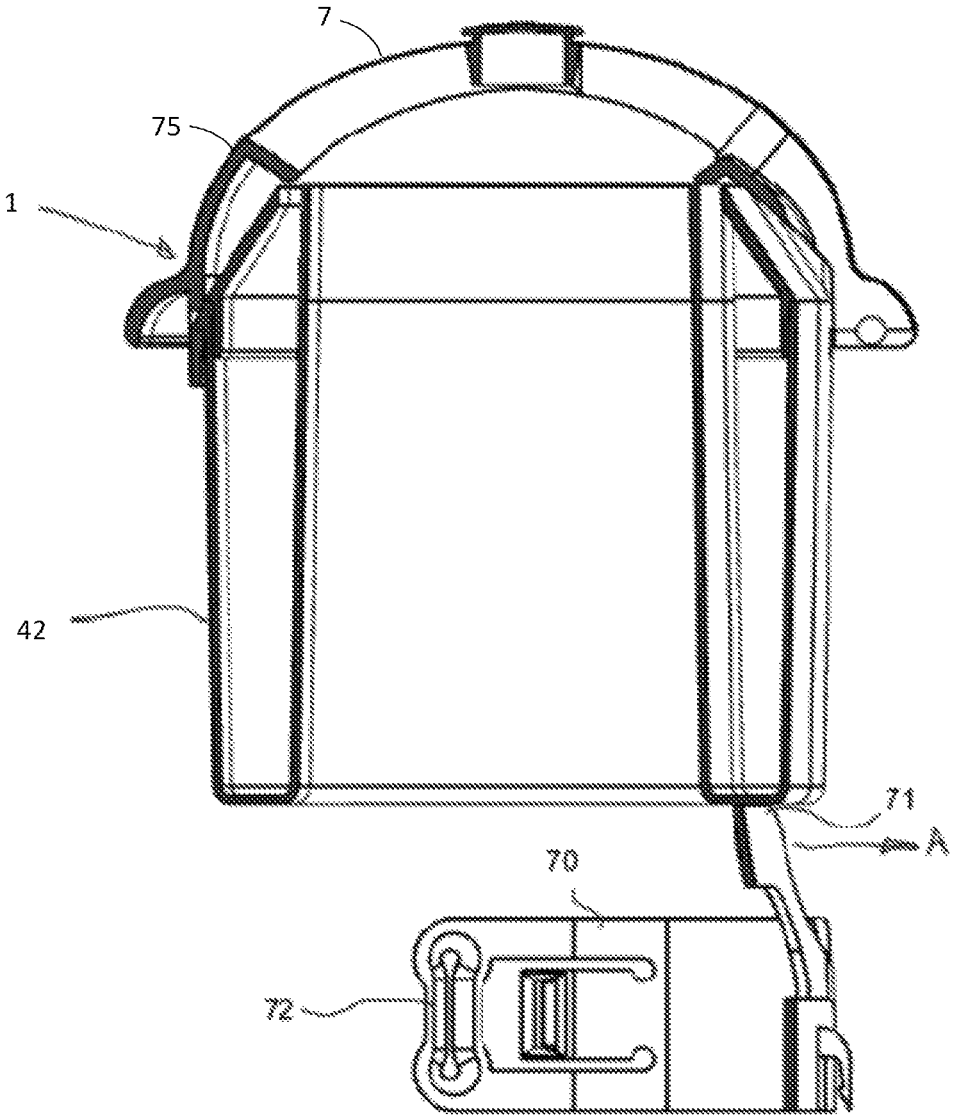

The container 1 as shown in FIGS. 17 through 26 is rectilinear in form and has curved side, top and bottom surfaces inside and out as shown to provide substantially smooth continuous surfaces, with few or no difficult to clean corners to aid in hygiene and cleaning, for example if there is a spill over or leakage of waste from the containment region. FIG. 26 shows the housing 3 has a lower most portion 74 that is scoop or bucket shaped to contain any leakage or spill should this occur.

Figure 17A:
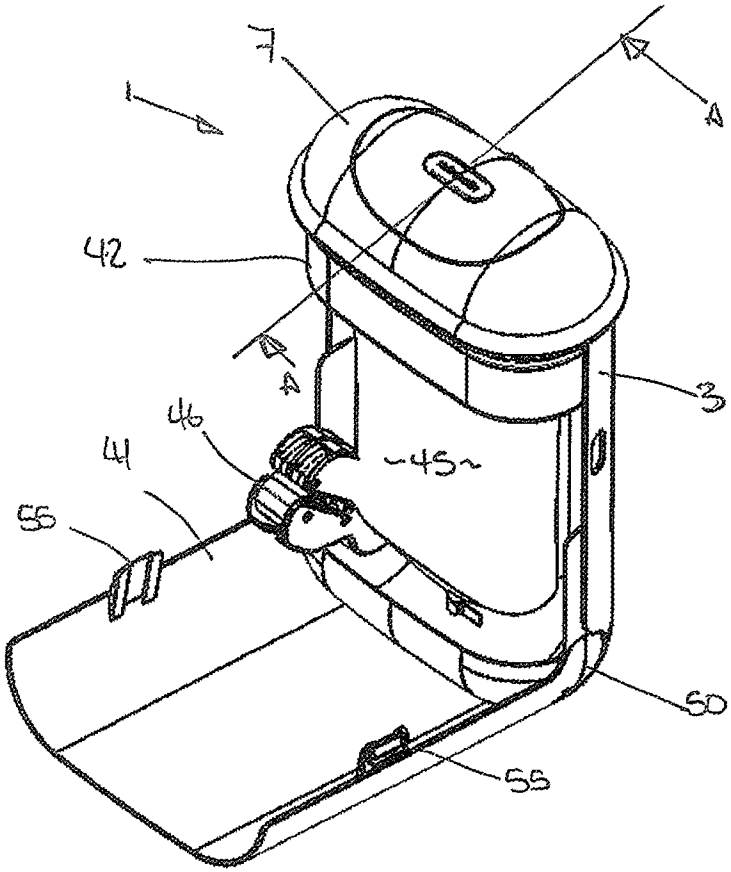

The housing 3 as shown in FIG. 17A consists of a main housing portion 3A, a closing portion 41, and an upper portion 75. The housing 3 has a mounting lip 76, seen as a circumferential ring in FIG. 17A. In the preferred embodiment the upper portion is separate from the housing for each of manufacture and then is assembled to the housing before installation, for example prior to shipping from the manufacturing facility. In the preferred form the upper portion 76 clips in known ways to the housing 3. Also in the preferred form the upper portion form the mounting lip 76.

Figure 27:
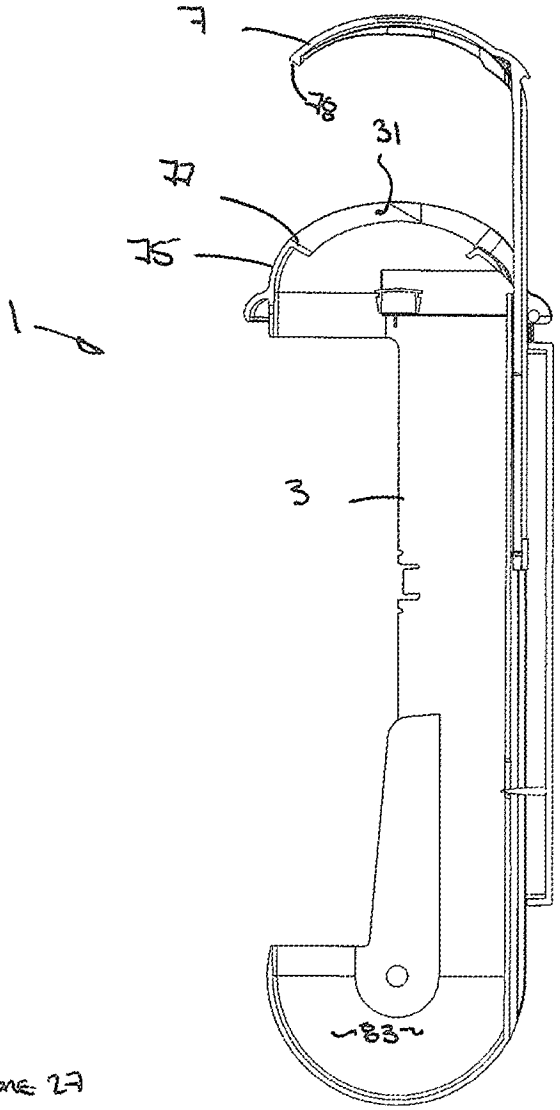
Figure 28:
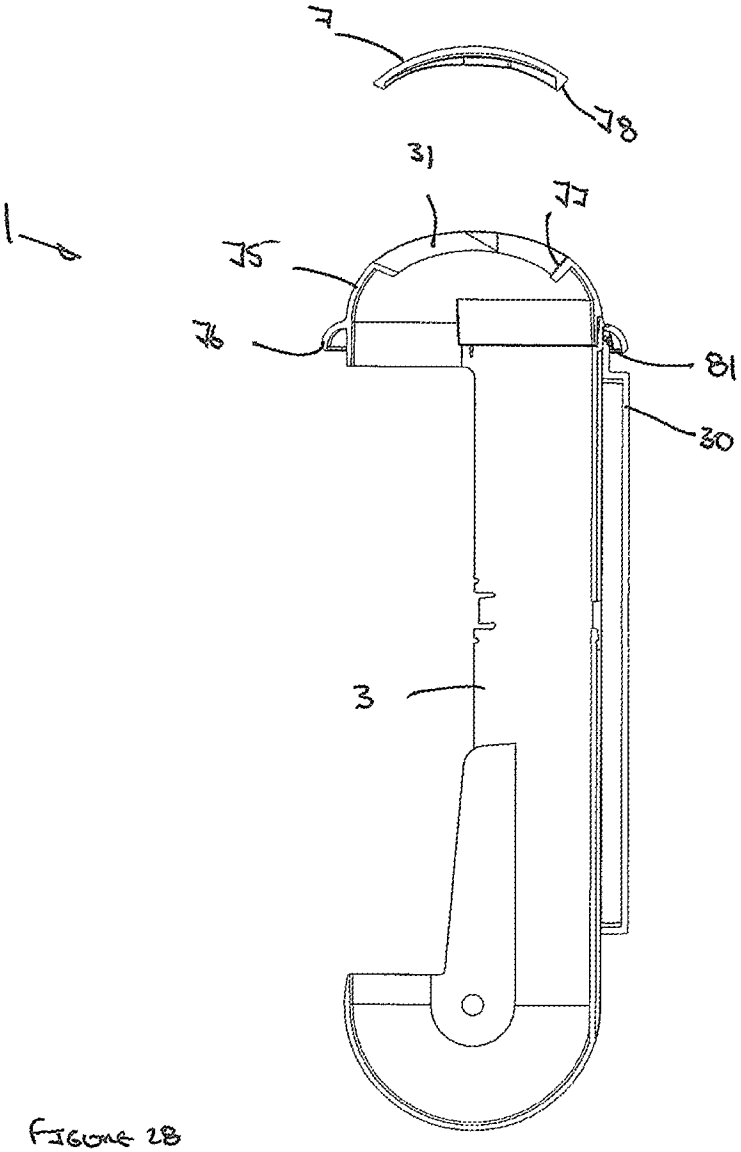
Figure 29:
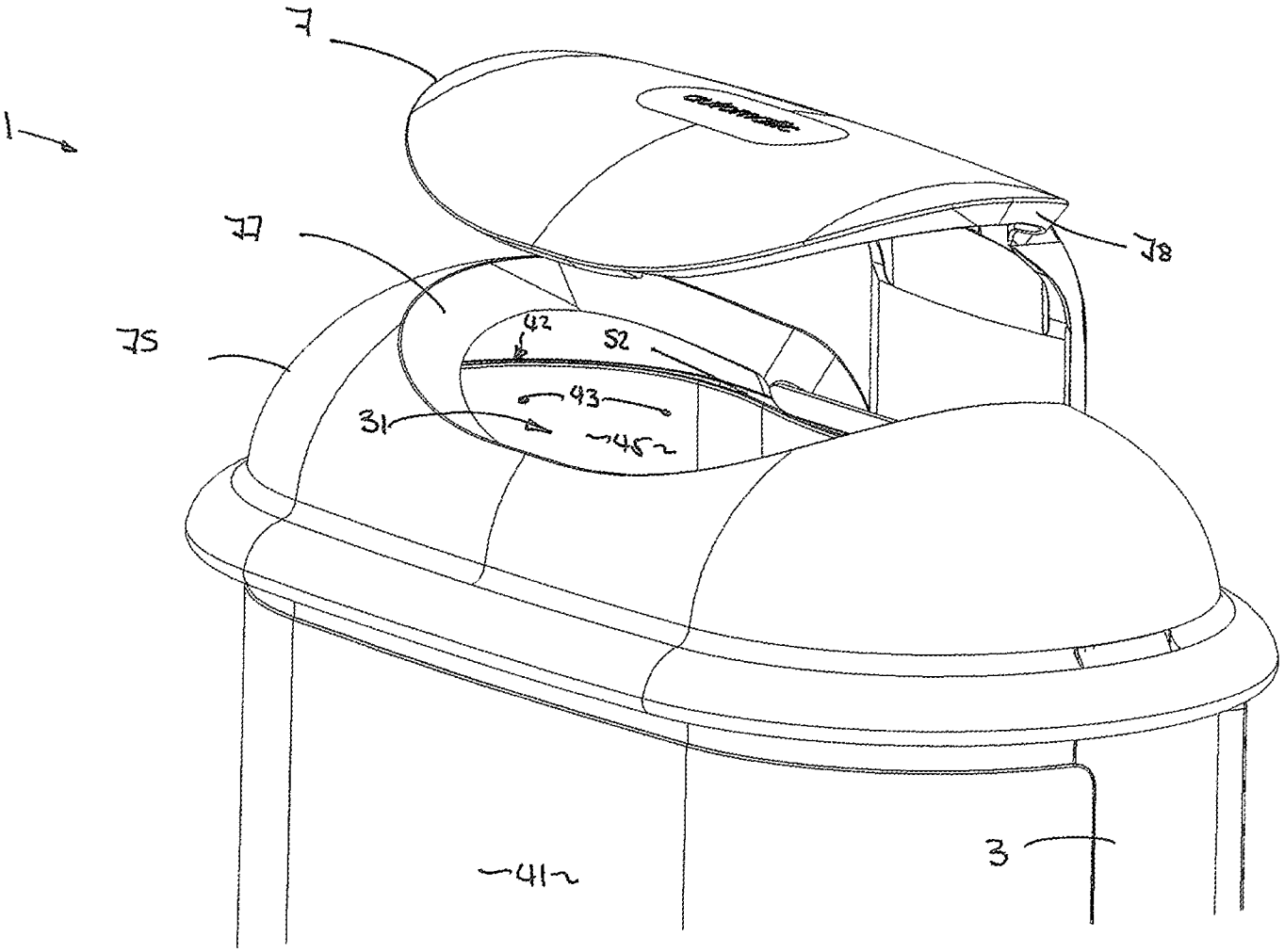

This embodiment of the container 1 in FIG. 17A has a housing 3 with an upper aperture 5 in the upper portion 75 which can be open and closed off by a lid 7. In the preferred form the lid 7 is received in a complimentary portion in the upper portion 75 as shown in FIGS. 27 through 29. The lower mating surface 77 and upper mating surface 78 of the lid 7 and upper portion 75 are shown in detail in FIG. 29. In addition to closing the aperture off, the close mating of the surfaces 77 and 78 ensures at least there is a good seal between the lid and the upper portion for example to prevent or reduce escape of odours. In the preferred form as shown the mating surfaces are frustoconical in form. The lower mating surface is angled downward toward the containment region. This angling downward also serves the purpose of ensuring that waste is directed toward the containment region and provides little or no surface for waste to catch or hang on. The frustoconical nature of the mating surfaces 77 and 78 also helps ensure the lid 7 returns to the same place each time on closing, again to aid in preventing or reducing escape of waste and odours.

Figure 17B:
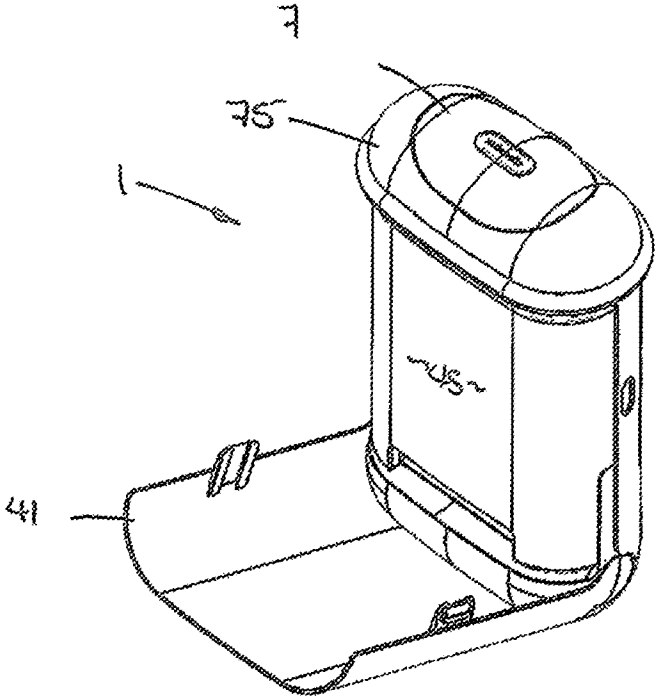
Figure 17C:
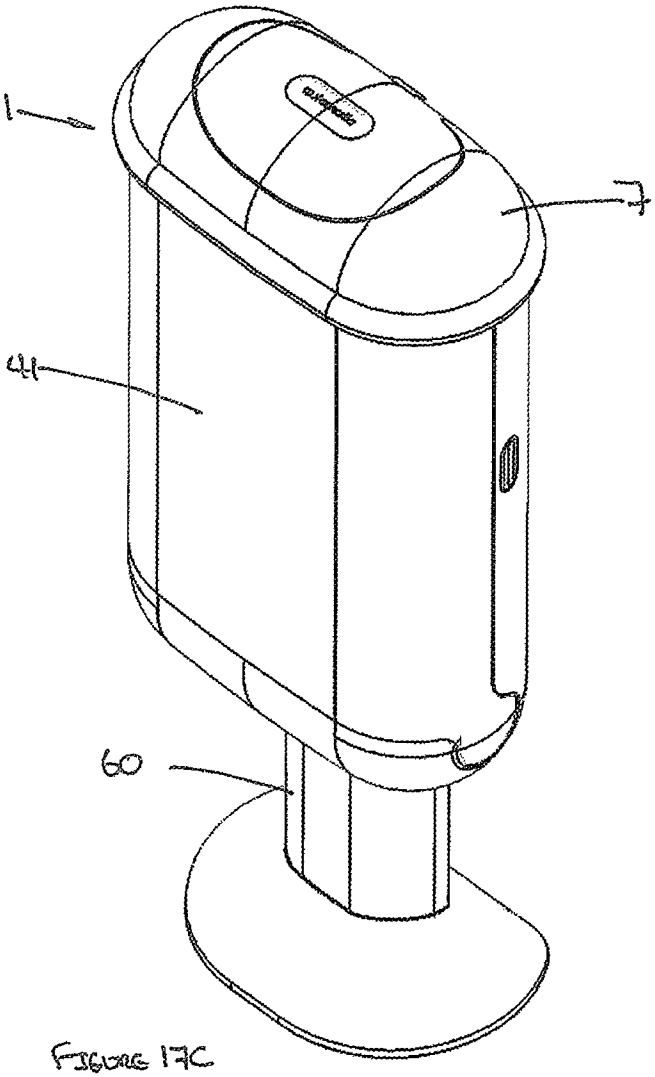
Figure 24:
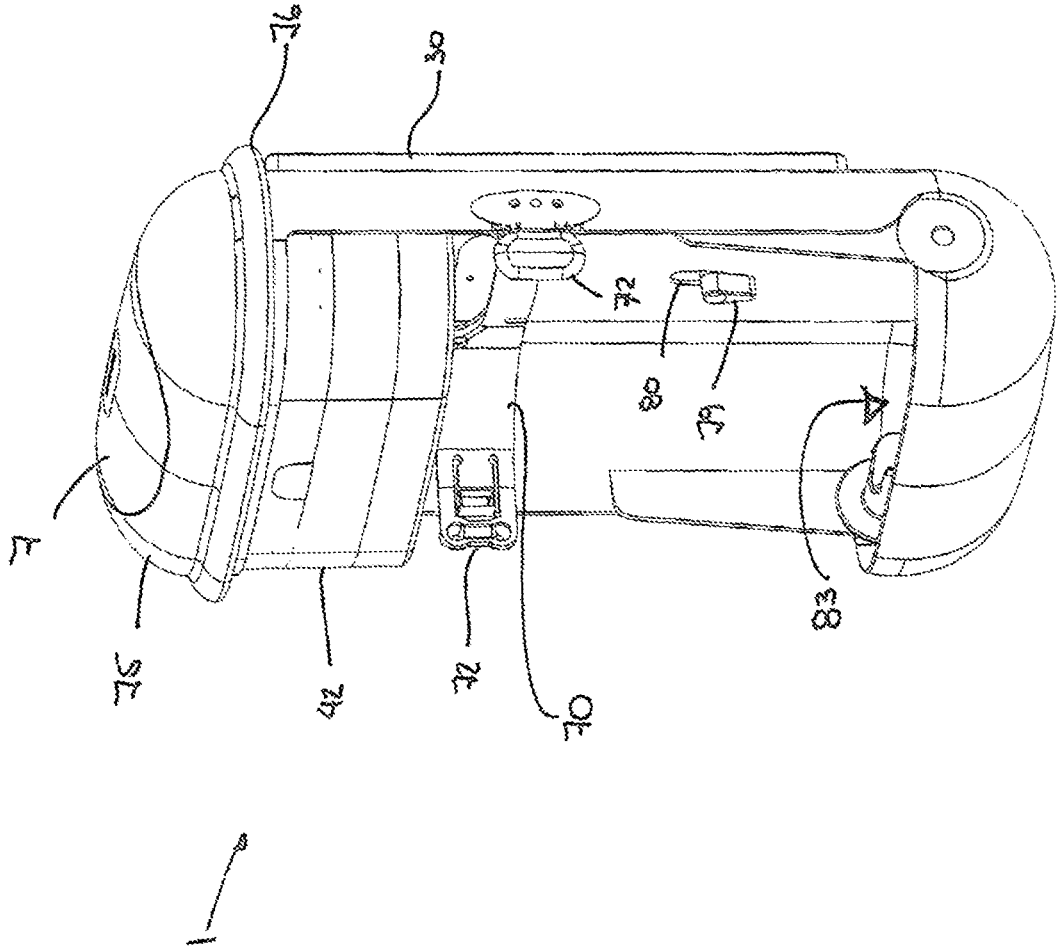
Figure 25:
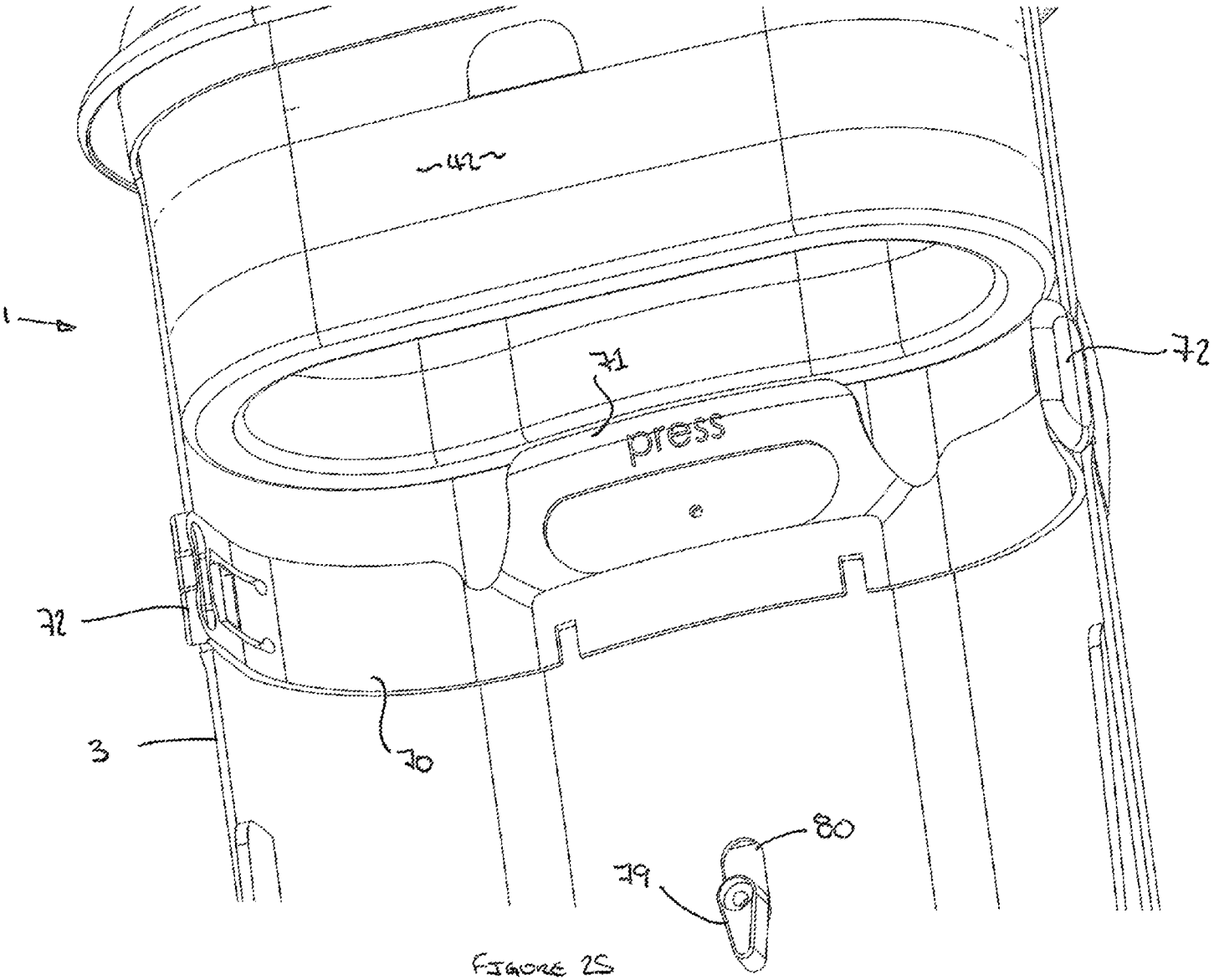

Again the container 1 can be releasably mounted to a wall or similar or can be free standing as shown in FIG. 17C using a floor stand 60. The container 1 can releasably connect to the wall mount bracket 30 or floor stand 60 to ease installation, servicing, cleaning or replacement. In the preferred form there is a releasable catch 79 as shown in FIG. 24 which is accessible from the interior of the housing. In the preferred form as shown the releasable catch 79 is on the wall bracket 30 or floor stand 60 and has a locked position as shown in FIG. 24. The releasable position has the releasable catch rotated through 180 degrees to then fit through the catch aperture 80. This system could be reversed also, and also the releasable catch 79 or similar may be on the housing to then engage with the wall bracket or floor stand. In addition to the releasable catch 79 the upper extension 81 of the wall bracket 30 under engages the mounting lip 76, preferably on the rear of the container, as shown in FIG. 28. Thus the container can be easily mounted or removed from the wall bracket or floor stand as necessary.

In addition to the manual operating lid 7 where the user lifts the lid up using a handle 19 similar to that shown in FIG. 2, an auto opener 21 to open the lid automatically, as earlier described, may be used. This may exist as a slim backpack that located between the container 1 and the wall bracket 31 or floor stand 60, and operates in a similar fashion.

Figure 17D:
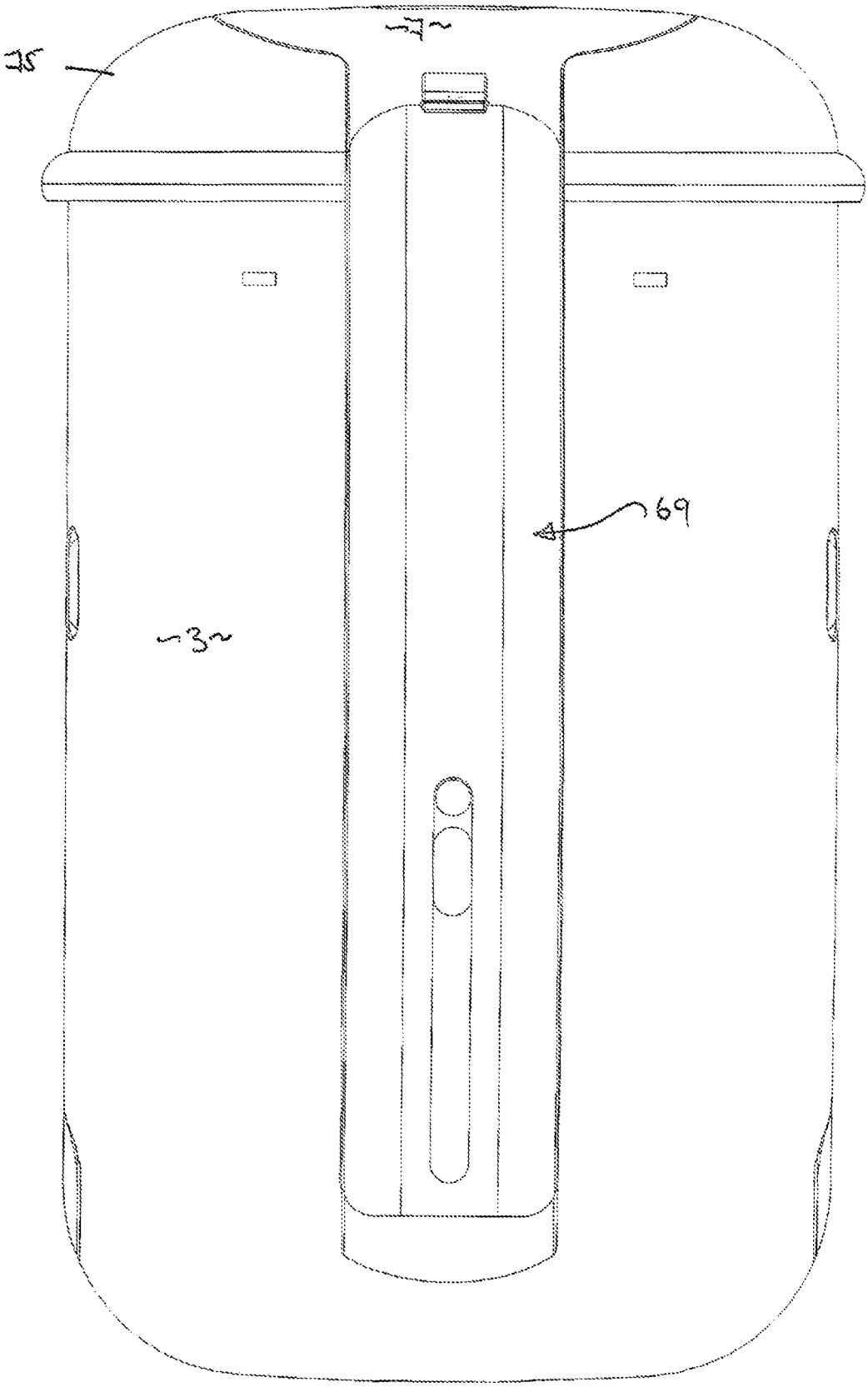
Figure 10:
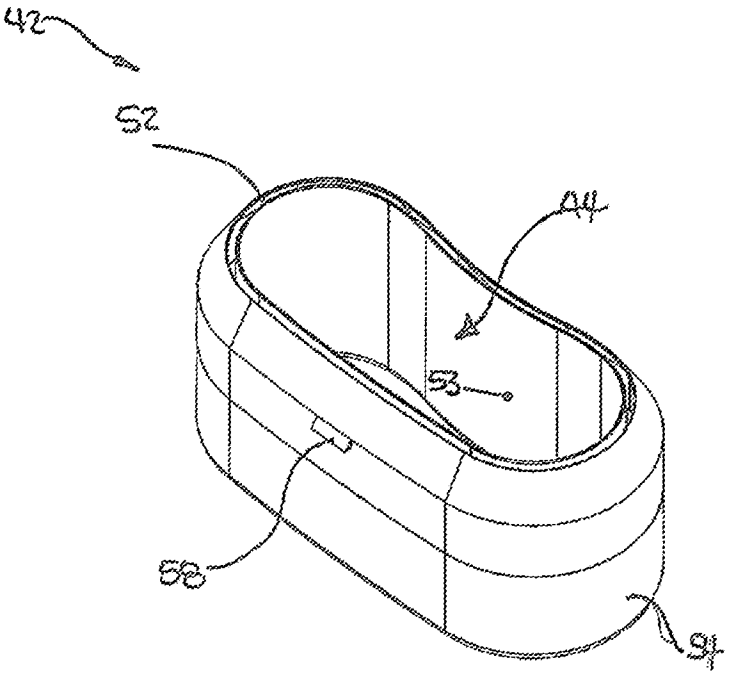

The lid 7 in this embodiment is on a sliding engagement as a sliding track 69 on an exterior rear surface of the housing as shown in FIG. 17D. This is similar to that used interiorly on the previous embodiment, but is an external form. The wall bracket 30 sits outside this sliding track 69 again to protect it and prevent it scraping on the wall or similar.

The housing 3 has a portion 41 as a clam shell that can open, in the preferred embodiment by a pivot point 50 at or toward a bottom of the housing 3. The portion 41 in the preferred form has a releasable engagement 55 with sides of the housing 3 to also enable it to be removed for example for replacement, cleaning or servicing. The result is the interior of the housing 3 can be accessed or closed off by the portion 41. In FIG. 17A and B the portion 41 is shown open to access to the interior of the housing 3. The lid 7 is in the position to close off the upper aperture 51. A containment 45 can be seen in the interior, and in FIG. 17A this is a length of plastics tubing from a cassette 42 described below.

Figure 22:
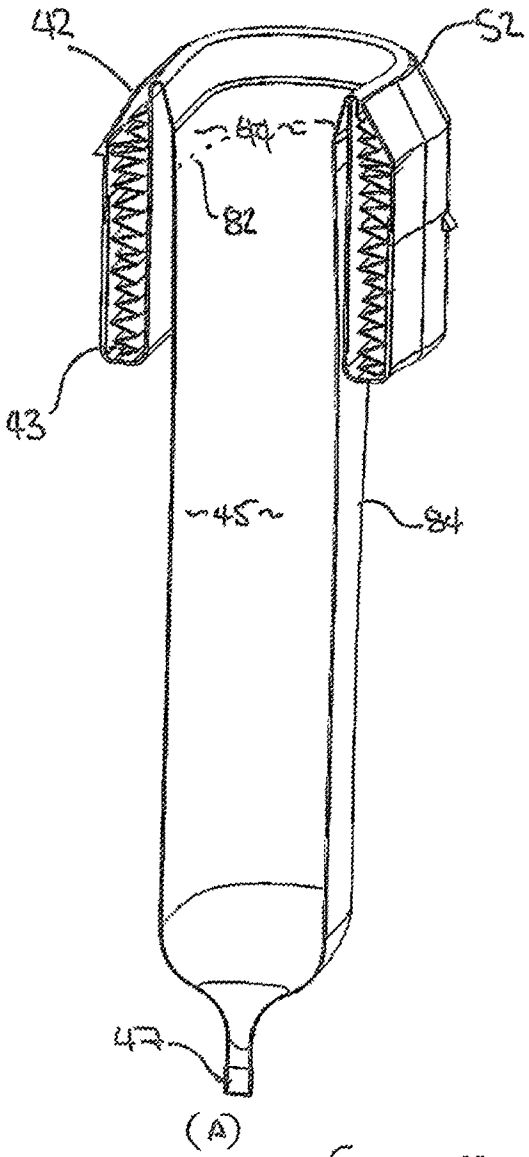
Figure 22B:
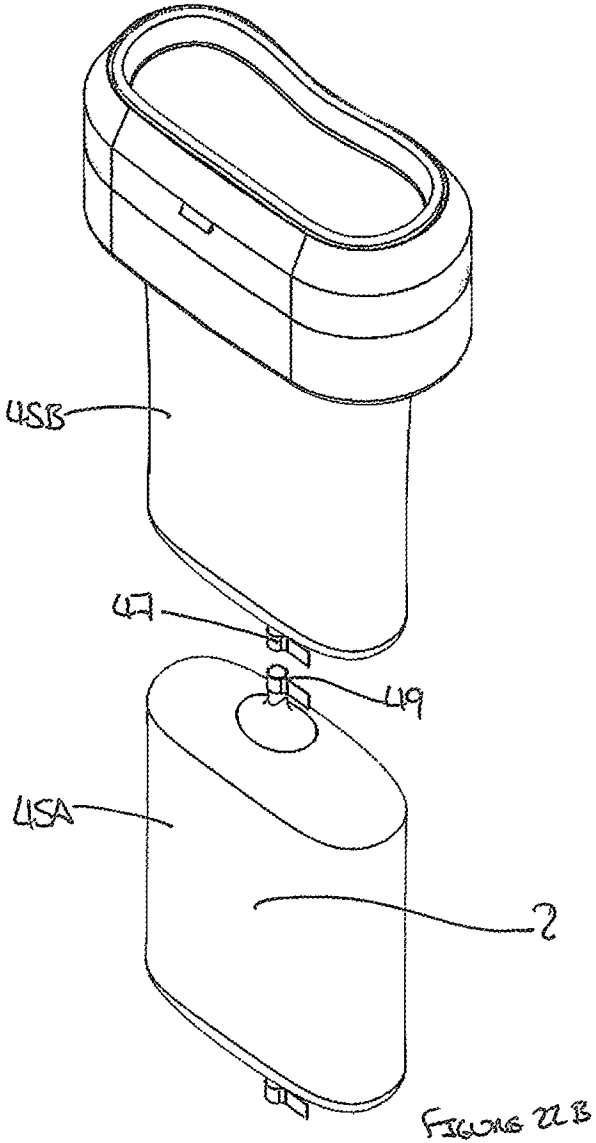
Figure 22C:
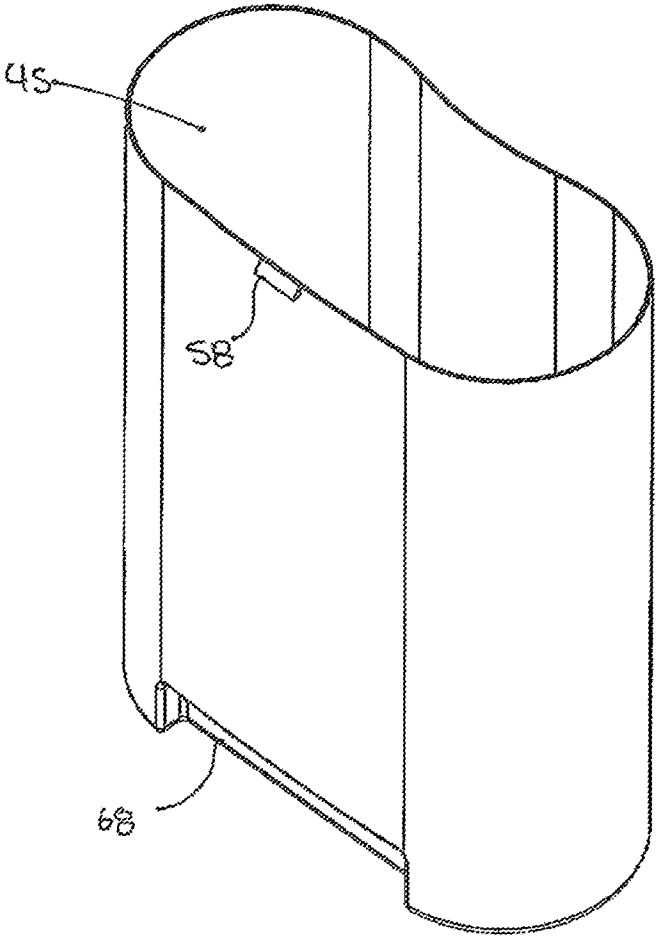
Figure 23:
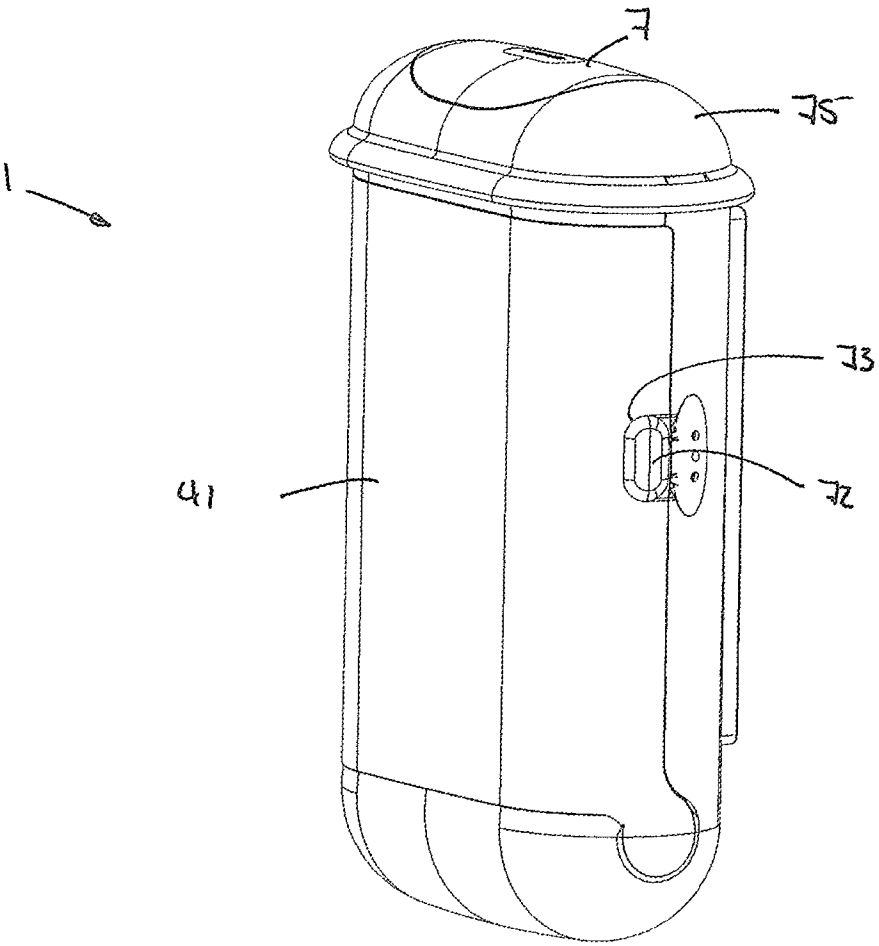

A sealer unit 46 is also visible, which is present in one embodiment. FIG. 17B shows another embodiment where a more rigid container is shown in FIG. 22C as the containment 45. This more rigid containment 45 may be made from a plastics material, or a paper, card or similar material, (which may be treated for longevity, e.g. waterproofness, and may also be recyclable). The rigid containment 45 may engage with the housing in a similar ways to the cassette 42, described below. A handle portion 68 is also present to aid with removal and installation.

In embodiments with no sealer unit, the bottom of the plastics tubing could be sealed manually by the user, for example a rubber band or knot could be used, to form the containment 45.

Figure 19:
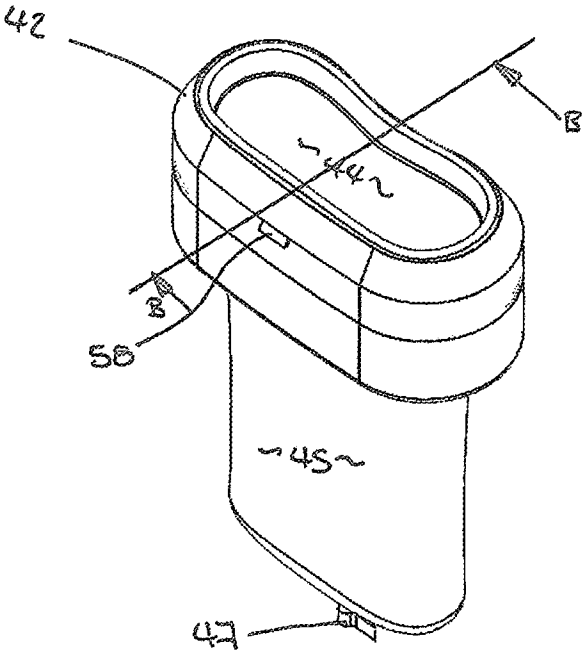
Figure 20:
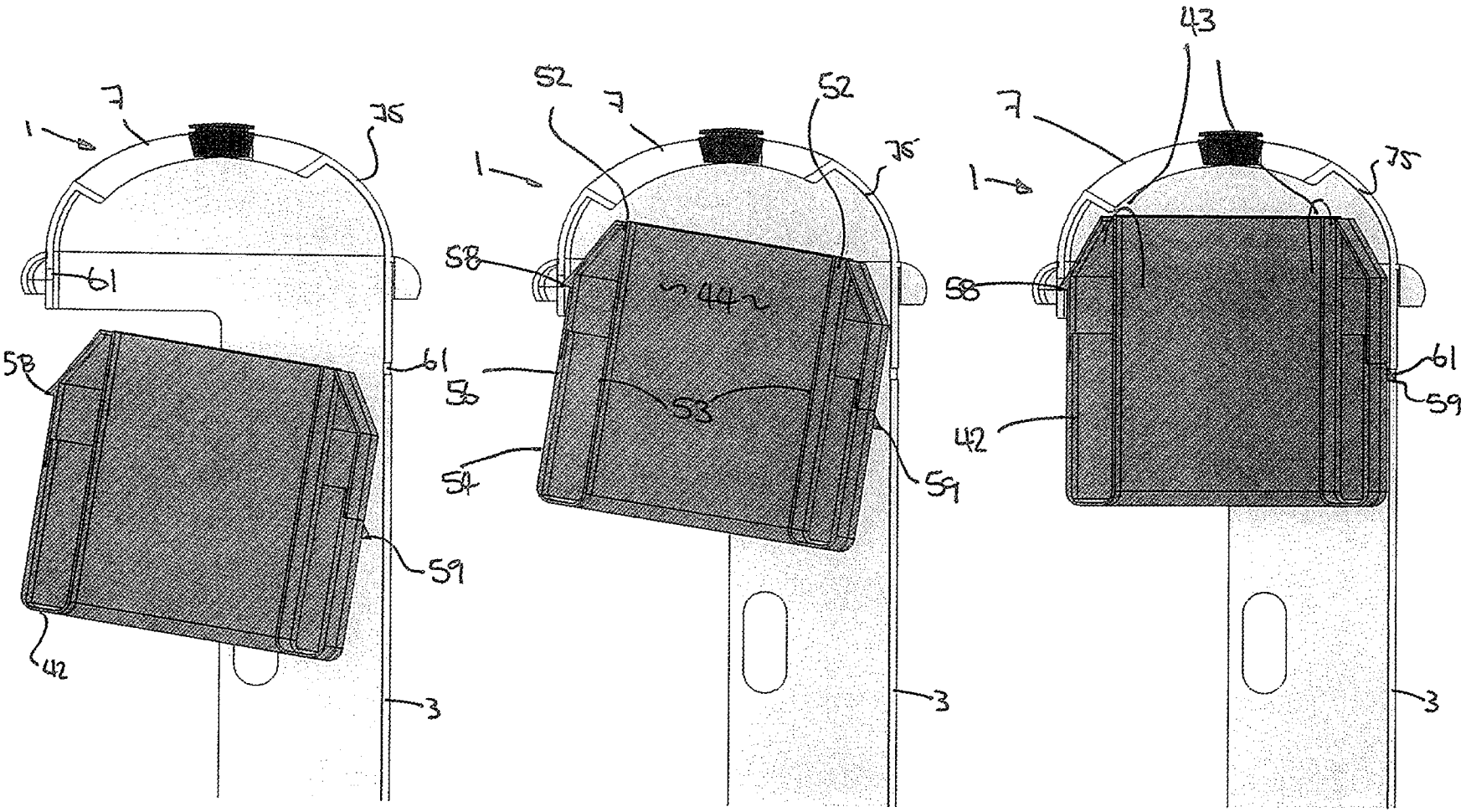
Figure 21:
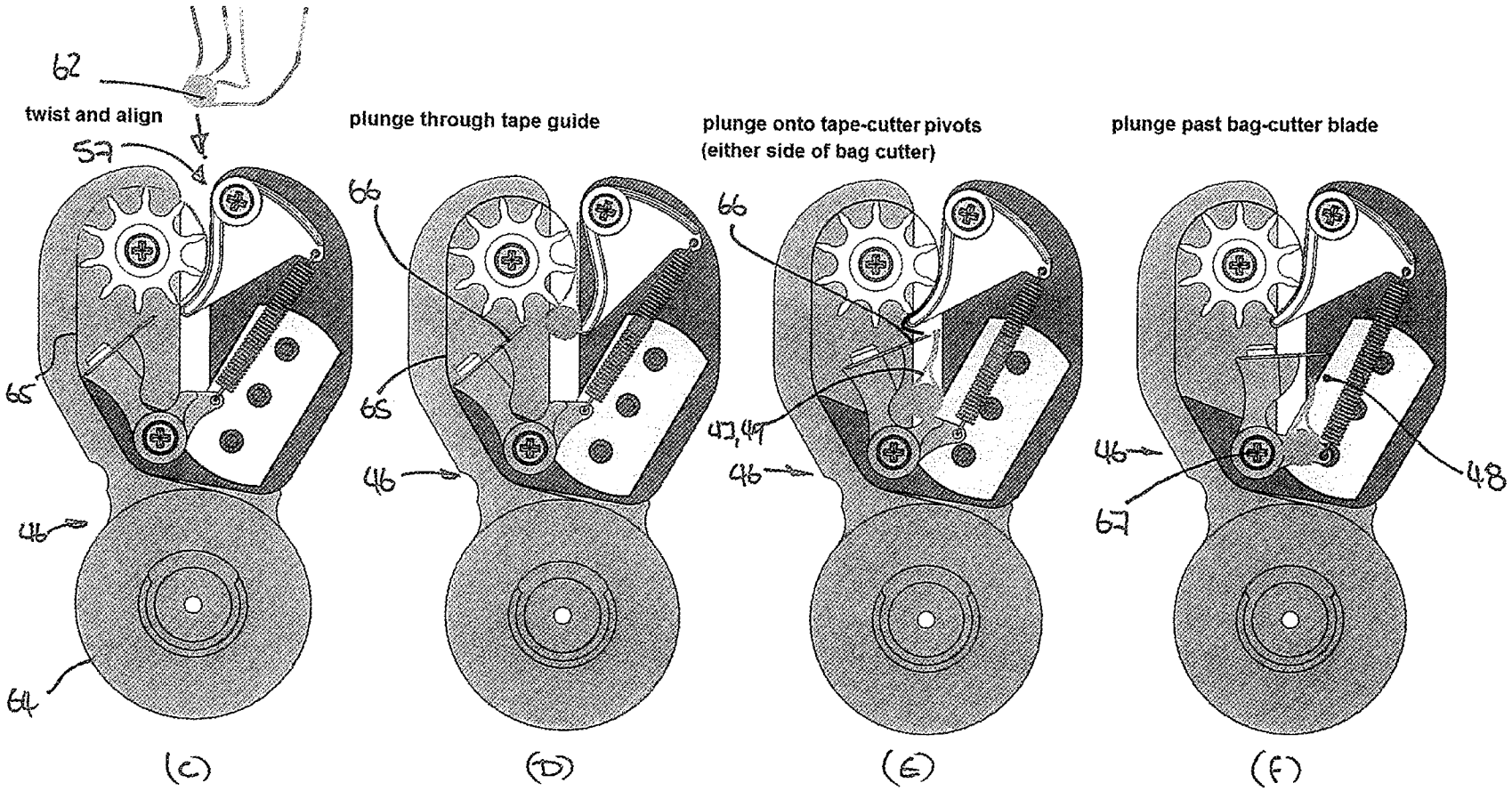

This further embodiment has an endless cassette 42 shown in FIGS. 18 through 20 located in an interior of the housing 3 of the sanitary container 1. The cassette 42 has a central aperture 44 and at its top has an exit 52 from an interior thereof. Shown in FIGS. 18 and 20 the cassette 42 in the preferred embodiment consists of an internal mandrel 53 and an outer cover 54 which is engaged to the internal mandrel. Within an interior 56 there is located a length of shirred plastics tubing 43 as shown in FIG. 22A. The tubing can exit the cassette 42 from the exit 52. In the preferred embodiment the exit 52 is located uppermost on the cassette 42 and immediately adjacent the central aperture 44. This provides as minimal surface area of the cassette itself as possible is exposed when waste is located in the container, as can be seen in FIG. 20 far right where the cassette 42 and therefore its plastics tubing fills the entire upper aperture to present a minimal soiling area when the lid 7 is lifted. The majority of any surface that may be soiled is covered by the plastics tubing 43 and is therefore replaced each time the waste is removed as is explained below. This is further shown in FIG. 29. In the preferred form the central aperture 44 is greater in size, and lies substantially peripherally outside, the waste aperture 31. Therefore any waste 2 placed through the waste aperture 31 has little chance of contacting anything other than the plastics tubing, and should only contact either a sloping or vertical wall.

The plastics tubing is drawn down the central aperture as shown in FIG. 19 and closed off at the bottom, for example by gathering and sealing with a suitable seal 47 as shown to form the containment 45.

The endless cassette 42 engages in a releasable way with the housing 3 and the sequence of engaging is shown in FIG. 20 from left to right of one preferred form using protruding portions 58 and 59. Disengaging is the opposite from right to left. This is so the cassette can easily be replaced, for example when the plastics tubing in its interior is exhausted, or at least is not sufficient to form a containment region. In the preferred form the engagement is a resiliently releasable one that relies on relative flexing of the housing 3 and the endless cassette 42. In one preferred form shown in FIG. 20 showing the sequence of installation (and reversal for removal) the engagable release is achieved by at least one first protruding portion 58 and at least one second protruding portion 59 which engage in complimentary recesses 61 in this example in the housing 3 interior. In alternative forms the protrusions may be on the housing and mate with complimentary recesses in the endless cassette 42. In the preferred form there is one of the first protrusion 58 and one of the second protrusion 59 or vice versa. The resilient nature of the housing and cassette allow sufficient flex to engage and disengage the cassette.

Other forms of retaining the cassette to the housing will be known to a person skilled in the art.

In a preferred form of the invention the housing has a lower concave portion 83 shown in FIGS. 24 and 27 with no holes in it to catch any leakage or spill from said waste, whether a liquid or a solid. The curved interior again provides no niches for waste to collect in and can easily be cleaned, for example by wiping or washing.

A sealer unit 46 as shown in FIG. 21(A) and (B) is present at or toward a bottom of the container 1 as shown in FIG. 17. When the portion 41 is opened in the preferred form the sealer unit 46 is moved outwardly as shown to facilitate its use. In the preferred form it is pivoted near or on the pivot 50 and has a frictional engagement with the portion to present outwardly when the portion 41 is opened.

The unit places a seal 47 on a gathering of the plastics tubing as shown in FIG. 22A with a cover 63 in FIG. 21B removed. The gathered tube 62 is placed at a throat 57 of the seal unit 46 and pushed down into the throat 57. This places a tape seal 47 from a supply of single sided adhesive tape 65 on a roll 64 about the gathered tubing 62. The adhesive in inwards facing on the length of tape 65 applied to it adheres to itself and the gathered tubing 62 when applied by the sealer unit 46. At least one tape cutter 66 is shown which when activated by the gathered tubing down the throat 57 rocks forward on a pivot 67 to sever the tape 65 from the remainder on the roll 64. In the preferred form the sharpened edge of the tape cutter 66 is angled to make the cut more efficient, clean and quick.

In the preferred form of the sealer unit 46 there is a tube cutter 48 downstream on the gathered tubing 62 of the apparatus that applies the seal. This cutter will cut any plastics tube that is extending beyond a certain distance from the first seal. In the most preferred form there is a further sealing apparatus to apply a second seal downstream of the cutter. The effect being that when a length of plastics tubing is gathered and presented to the sealer unit 46 and pushed down into its throat the sealer unit will place two seals at short distance apart from each other and also sever via the cutter 48 the length of plastics tubing in two between the two placed seals. In this preferred form there may be two rolls 64 side by side, (which in turn are each cut by a respective tape cutter 66) or in the most preferred form there is only one roll 65 wide enough to supply both seals and the tape cutter 66 severs it off as described and the tube cutter 48 also severs the one applied length of tape 65 into two to form the first seal 47 and second seal 49 as shown in FIG. 22B. Shown in FIG. 22B is the full containment 45A with waste inside now sealed off which can then be easily handled and disposed of, and new containment 45B ready to receive new waste.

The container 1 with sealer unit 46 in this preferred form operates in the following way. A length of plastics tubing is 43 is pulled down from the cassette 42 and the lower end is sealed 47 by the sealer unit 46 in the action described above to form a containment 45 for waste. The container 1 can then be used to receive waste in the described fashion. When it is time to service the unit, either as part of a regular schedule, or when reported as full or near full, the portion 41 is opened to reveal the interior. The existing containment 45 is then pulled downwardly and a new containment of plastics tubing comes from the endless cassette 42. The plastics tubing is pulled down until a sufficient containment length is achieved—normally this will be until a lower part of the new containment is at or towards the bottom of the container 1. The plastics tubing at a lower point of the new containment (which is also an upper point of the existing containment containing waste to be removed) is then gathered and presented to the sealer unit 46. The sealer unit, in the preferred form in one movement seals and then severs the existing containment from the new containment by the cutter 48. In the first part of this motion the sealer unit then also places a seal on the top of the existing containment effectively sealing the waste therein. This now sealed existing containment can then be removed for disposal. The sealer unit at the same time places a first seal on a lower point of the new containment to close this off. The container then has the portion 41 closed and is ready for use again.

In a further embodiment of the present invention, in FIGS. 23 through 26, an alternative method and apparatus of retaining the cassette 42 in the sanitary container 1 is shown. A pressbar 70 supports the cassette 42 from below by way of a support portion 71 that bears on a lower surface of the cassette 42. The upper portions of the cassette 42 (shown in cross section in FIG. 26) nest in a complimentary manner with the interior of the upper region of the sanitary container 1. In the preferred form shown the periphery of the upper portion of the cassette 42 is inwardly tapered to engage a like portion in the sanitary container. Thus the engagement of the upper portion of the cassette with the sanitary container prevents the cassette moving outwardly or upwardly, and the support portion 71 of the pressbar 70 prevents the cassette from moving down, therefore the cassette is locked into place.

To remove the cassette 42, the pressbar is pushed (direction A in FIG. 26) toward the back of the sanitary container inner wall in the region of the support portion 71 such that it then clears the lower portion of the cassette 42, and the cassette is then free to be dropped out and removed. Installation of the cassette is the reverse.

The press bar also, in one preferred embodiment is a one piece moulding that also contains clip portions 72 that engage with complimentary apertures 73 in the cover of the sanitary container. This is similar but the reverse of the previous embodiment shown where the clip equivalents engaged from the cover into the body of the sanitary container.

In other forms of the invention there is no cutter 48 and the plastics tubing has perforations 82 to enable it to be torn off at desired intervals. For example the perforations may be at intervals slightly greater than the total internal height of the container. In this way when sealed at the bottom the perforation above is still contained within the cassette. This allows safe and clean handling of this portion for tearing off, sealing the containment shut, and sealing off the bottom of the next containment as the next lot of perforations in normal use are hidden still in the cassette 42. In FIG. 22(A) the perforations 82 are shown, where the tubing 84 has been pulled further down from the cassette 22.

The foregoing description of the invention includes preferred forms thereof. Modifications may be made thereto without departing from the scope of the invention.

The invention claimed is:

1. A cassette for a sanitary container, said sanitary container having a housing with a hollow interior and an upper aperture, with a portion of said housing able to open and reveal at least in part, said hollow interior, said cassette comprising:

a. a central mandrel, about which a length of plastics tubing can be located in a shirred state, said central mandrel having a central aperture running therethrough, b. an outer cover to locate about said central mandrel and said shirred plastics tubing, c. said central mandrel and said outer cover to thereby enclose said shirred plastics tubing save for an endless exit aperture at an uppermost periphery of and immediately adjacent to said central aperture, whereby said shirred plastics tubing can leave said cassette via said endless exit aperture and which then can flow in an un-shirred state down through said central aperture of said cassette toward a bottom of said housing to form an upwardly open containment within said hollow interior, wherein said cassette is configured to be internally non-rotationally mounted within said hollow interior of said sanitary container, accessed for removal and installation when said portion is open, removed from said housing in a downwards direction, installed in an upwards direction, and located substantially around or away from a periphery of an upper aperture of said container, to form an upwardly open containment within said hollow interior.

2. A cassette as claimed in claim 1 wherein said cassette has an upper surface which slopes upwardly and inwardly to said central aperture.

3. A cassette as claimed in claim 1 wherein said exit aperture is immediately proximal said central aperture.

4. A cassette as claimed in claim 1 wherein said internal mandrel and said outer cover between them define said exit aperture at or near a top of said cassette.

5. A cassette as claimed in claim 1 wherein said cassette is configured to be substantially complimentary to an interior surface of said housing.

6. A cassette as claimed in claim 1 wherein said cassette is configured to have a releasable engagement with said housing.

7. A cassette as claimed in claim 5 wherein said releasable engagement comprises at least one first protruding portion on a forward facing surface of said cassette to engage in a complimentary portion on an interior surface of said housing, and at least one second protruding portion to engage on another interior surface of said housing.

8. A cassette as claimed in claim 7 wherein said at least one first protruding portion is at a different height to said at least one second protruding portion such that said cassette is configured to be located into place by engaging first either of said at least one first protruding portion or said at least one second protruding portion and then engaging said at least one second protruding portion or said at least one first protruding portion respectively.

9. A cassette as claimed in claim 1 wherein said cassette is configured to be held in place by at least an upper portion of said cassette being complimentary to an interior of said sanitary container such that said cassette is retained from moving upwardly or outwardly.

10. A cassette as claimed in claim 1 wherein said cassette is configured to be releasably supported from below by a resiliently deformable elongate member.

11. A method of use of a cassette for a sanitary container, said sanitary container having a housing with a hollow interior and an upper aperture, with a portion of said housing able to open and reveal at least in part, said hollow interior, said method comprising:

a) accessing, when said portion is open, an internally non-rotationally mounted cassette having a central aperture within said hollow interior of said container, said cassette to hold a length of plastics tubing in a shirred state, the cassette further having an endless exit aperture at an uppermost periphery of and immediately adjacent to said central aperture, whereby said shirred plastics tubing can leave said cassette upwardly via said endless exit aperture, and then flow down through the central aperture to form a containment, b) if said cassette is not empty, then i. drawing downward an existing containment substantially within a hollow interior of said container to form a new containment replenished from said central aperture of said cassette, ii. sealing said new containment at a lower end thereof to close said lower end, and iii. severing said existing containment from said new containment, to thereby allow removal of said existing containment and any waste therein from said container, or c) if said cassette is empty, or nearly empty, then, i. releasing said cassette from said hollow interior in a downward direction and removing said cassette and any existing containment present, ii. installing a new cassette into said hollow interior in an upwardly direction, iii. drawing a new containment downwardly if necessary, and if not sealed at a lower end, then sealing said new containment, to thereby provide a refreshed containment, and then closing the portion to close the hollow interior.

* * * * *